US006888526B2

(12) United States Patent
Morita

(10) Patent No.: US 6,888,526 B2
(45) **Date of Patent: *May 3, 2005**

(54) VOLTAGE SUPPLYING DEVICE, AND SEMICONDUCTOR DEVICE, ELECTRO-OPTICAL DEVICE AND ELECTRONIC INSTRUMENT USING THE SAME

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 310 days.

This patent is subject to a terminal disclaimer.

(21) Appl. No.: 10/092,377

(22) Filed: Mar. 5, 2002

(65) Prior Publication Data

US 2002/0145600 A1 Oct. 10, 2002

Related U.S. Application Data

(63) Continuation-in-part of application No. 10/092,356, filed on Mar. 5, 2002, now Pat. No. 6,603,294, which is a continuation-in-part of application No. 10/016,687, filed on Dec. 11, 2001, now abandoned, which is a continuation of application No. 09/692,740, filed on Oct. 19, 2000, now Pat. No. 6,366,065.

(30) Foreign Application Priority Data

Oct. 21, 1999 (JP) ..... 11-299159

(51) Int. Cl.[7] ..... G09G 3/36
(52) U.S. Cl. ..... 345/95
(58) Field of Search ..... 345/87, 89, 95, 345/98, 100, 99, 211, 212; 323/280, 282, 283, 273

(56) References Cited

U.S. PATENT DOCUMENTS

| | | | | |
|---|---|---|---|---|
| 5,243,333 A | | 9/1993 | Shiba et al. | |
| 6,157,360 A | | 12/2000 | Jeong et al. | |
| 6,160,533 A | * | 12/2000 | Tamai et al. | 345/89 |

FOREIGN PATENT DOCUMENTS

| | | |
|---|---|---|
| EP | 0-837559 | 4/1998 |
| JP | 06-161570 | 6/1994 |
| JP | 10-301539 | 11/1998 |
| JP | 11-161237 | 6/1999 |
| JP | 11-164174 | 6/1999 |
| WO | 98/40873 | 9/1998 |

* cited by examiner

*Primary Examiner*—Chanh Nguyen
(74) *Attorney, Agent, or Firm*—Hogan & Hartson, LLP

(57) ABSTRACT

A voltage supplying device comprises a reference voltage generating circuit, a first impedance conversion circuit for performing the impedance conversion on a reference voltage, a digital-analogue converter (DAC) and a second impedance conversion circuit for performing the impedance conversion on a voltage from the DAC. A first switching element is provided between the output of the second impedance conversion circuit and the load capacitance. A first bypass line is provided for bypassing the second impedance conversion circuit and the first switching element, and a second switching element is provided on the bypass line. In the first period of the charging period, the output of the second impedance conversion circuit is supplied to the load capacitance. In the second period of the charging period, the output of the DAC is supplied to the load capacitance.

20 Claims, 19 Drawing Sheets

STATE OF FIRST PERIOD t1

STATE OF SECOND PERIOD t2

VOLTAGE SUPPLYING DEVICE, AND SEMICONDUCTOR DEVICE, ELECTRO-OPTICAL DEVICE AND ELECTRONIC INSTRUMENT USING THE SAME

This application is a continuation-in-part application of Ser. No. 10/092,356 filed Mar. 5, 2002, now U.S. Pat. No. 6,603,294, which is a continuation-in-part application of Ser. No. 10/016,687, filed Dec. 11, 2001, now abandoned, which is a continuation of application Ser. No. 09/692,740 filed Oct. 19, 2000, now U.S. Pat. No. 6,366,065 which application is hereby incorporated by reference in its entirety.

BACKGROUND OF THE INVENTION

1. Field of the Invention

The present invention relates to a voltage supplying device, and a semiconductor device, an electro-optical device and an electronic instrument using the voltage supplying device.

2. Description of Related Art

In recent years, there are devices requiring a highly accurate voltage supply, for example, a liquid crystal display.

In an active matrix type of liquid crystal display or a simple matrix type of liquid crystal display, the number of grayscales (or colors) of a liquid crystal panel is highly improved, and a voltage to be applied is developed to be more precise.

In order to increase the number of grayscales of a liquid crystal panel, a thin film transistor (TFT) liquid crystal device which is an active matrix type of liquid crystal display uses three colors of RGB (red, green and blue) which includes data signals constituted of 6-bit data (64 grayscales, ca. 260,000 colors) or 8-bit data (256 grayscales, ca. 16,770,000 colors), for example.

With the increase in the number of grayscales, a technique of setting a voltage level more precisely is required.

According to the characteristics in relationship between the applied voltage and the panel transmittance of a liquid crystal panel, the rate of change in panel transmittance with respect to the applied voltage is large where the transmittance is in the middle level around 50%, and is decreased when the panel transmittance approaches 100% or 0%. Therefore, in the region where the panel transmittance is in the middle level, a slight deviation in the applied voltage has a great influence on a gray level. In order to suppress the change in panel transmittance, a voltage to be applied to liquid crystal is required to be supplied more precisely.

The maximum permissible level in dispersion of a voltage to be applied to liquid crystal is ±5 mV for 64 grayscales and ±1 to ±2 mV for 256 grayscales, for example, and more precise voltage is required to be applied to liquid crystal when the number of grayscales is increased. Although the dispersion in the threshold voltage VTH of an ordinary IC chip is allowed to range from several tens mV to several hundreds mV, a liquid crystal display with the increased number of grayscales has a severer maximum permissible level. It can be predicted that further increase in the number of grayscales in future requires more precise setting method for a voltage to be applied to liquid crystal.

Consequently, there are conventionally various method of generating grayscale voltages in a driving circuit of a liquid crystal panel, such as a voltage selecting method, a time sharing method, or a digital-analog conversion method.

FIG. 4 shows a conventional voltage supplying device of the method using a digital-analogue conversion device (hereinafter referred to as a DAC method).

A voltage follower circuit 72, into which an output from a DAC 70 is entered, functions as an impedance converter, and in the case of a voltage follower circuit 72 in an ideal state, a voltage of a node 201 entered into a non-inverse input terminal becomes equal to a voltage of a node 202 entered into an inverse input terminal. However, conventionally in the voltage follower circuit 72 not compensated by an offset canceling circuit, an offset is formed between the input and the output due to dispersion in performance of respective transistors, so as to form a difference in voltage between the node 201 and the node 202.

FIG. 4 shows a voltage supplying device for solving the problem. The output from the DAC 70 is supplied to the non-inverse input terminal 201 of the voltage follower circuit 72, and the output of the voltage follower circuit 72 is returned to the inverse input terminal 202. In the course of the circuit connecting the output line and the non-inverse input terminal 201, a switching element Q10, a capacitance C10 and a switching element Q12 are connected in series. On the negative feedback line connected to the inverse input terminal 202, only a switching element Q1 is present. The switching element Q10 is connected in parallel to the capacitance C10 and the switching element Q11.

In a first period, the switching element Q11 is off, and the switching element Q10 and the switching element Q12 are on, whereby an offset voltage between the input and the output of the voltage follower circuit 72 is charged in the capacitance C10. In a second period, the switching element Q11 is on, and the switching element Q10 and the switching element Q12 are off, whereby a charge of offset canceling charged in the capacitance C10 is superposed and returned to the inverse input terminal 202 of the voltage follower circuit 72.

According to the foregoing manner, the offset is cancelled out by applying a reverse voltage corresponding to the offset in such a manner that the capacitance C10 for offset canceling is provided on the circuit connecting the output line and the non-inverse input terminal 201 of the voltage follower circuit 72.

In the data driver of the conventional DAC method shown in FIG. 4, the capacitance C10 as the offset canceling circuit is necessarily housed in the chip. However, it requires a large area since the capacitance C10 having a sufficiently larger capacity than the input capacity of the voltage follower circuit 72. When the offset canceling capacity is too small, it is regarded as a noise in the input capacity of the voltage follower circuit 72, and thus the noise is superposed on the output voltage.

Furthermore, in order to charge the offset voltage in the offset canceling capacitance C10, a period of time of from 3 to 5 $\mu$s is generally required.

In the active matrix type of liquid crystal display of these kinds, the horizontal scanning period (select period) is necessarily set at a short period when high definition display is conducted by increasing the number of pixels in one line.

For example, the select period becomes as short as from 8 to 12 $\mu$m in high definition display of SXGA.

In this case, it becomes difficult to assure a period of time for offset canceling when the period for charging the capacitance C10 for offset canceling occupies the select period.

BRIEF SUMMARY OF THE INVENTION

The invention has been developed taking the problems into consideration, and an advantage thereof is to provide a voltage supplying device that can promptly and precisely provide a required charging voltage without an offset canceling circuit, and a semiconductor device, an electro-optical device and an electronic instrument using the same.

According to one aspect of the present invention, there is provided a voltage supplying includes a reference voltage generating circuit having a ladder resistance circuit to which a plurality of resisters are connected in series, which outputs a plurality of voltages divided in the ladder resistance circuit as a plurality of gamma-corrected reference voltages and a plurality of first impedance conversion circuits which perform impedance conversion on the plurality of reference voltages from the reference voltage generating circuit and output the converted voltages. The voltage supplying device also includes a voltage selection circuit having a plurality of analogue switches one of which is turned on based on grayscale data, which selects one of the plurality of reference voltages from the plurality of first impedance conversion circuits, a second impedance conversion circuit which performs impedance conversion on a voltage from the voltage selection circuit and outputs the converted voltage, a first switching element for blocking an output of the second impedance conversion circuit and a first bypass line for shorting input and output lines of the second impedance conversion circuit. The voltage supplying device further includes a second switching element provided on the first bypass line, a plurality of third switching elements for blocking an output of the plurality of first impedance conversion circuits, a plurality of second bypass lines for shorting input and output lines of the respective plurality of first impedance conversion circuits and a plurality of fourth switching elements provided on the respective plurality of second bypass lines.

Furthermore, the first switching element is turned on and the second switching element is turned off in the first period of the charging period, and the first switching element is turned off and the second switching element is turned on in the second period of the charging period which follows alter the first period.

DETAILED DESCRIPTION OF THE PREFERRED EMBODIMENTS

Figure 1:
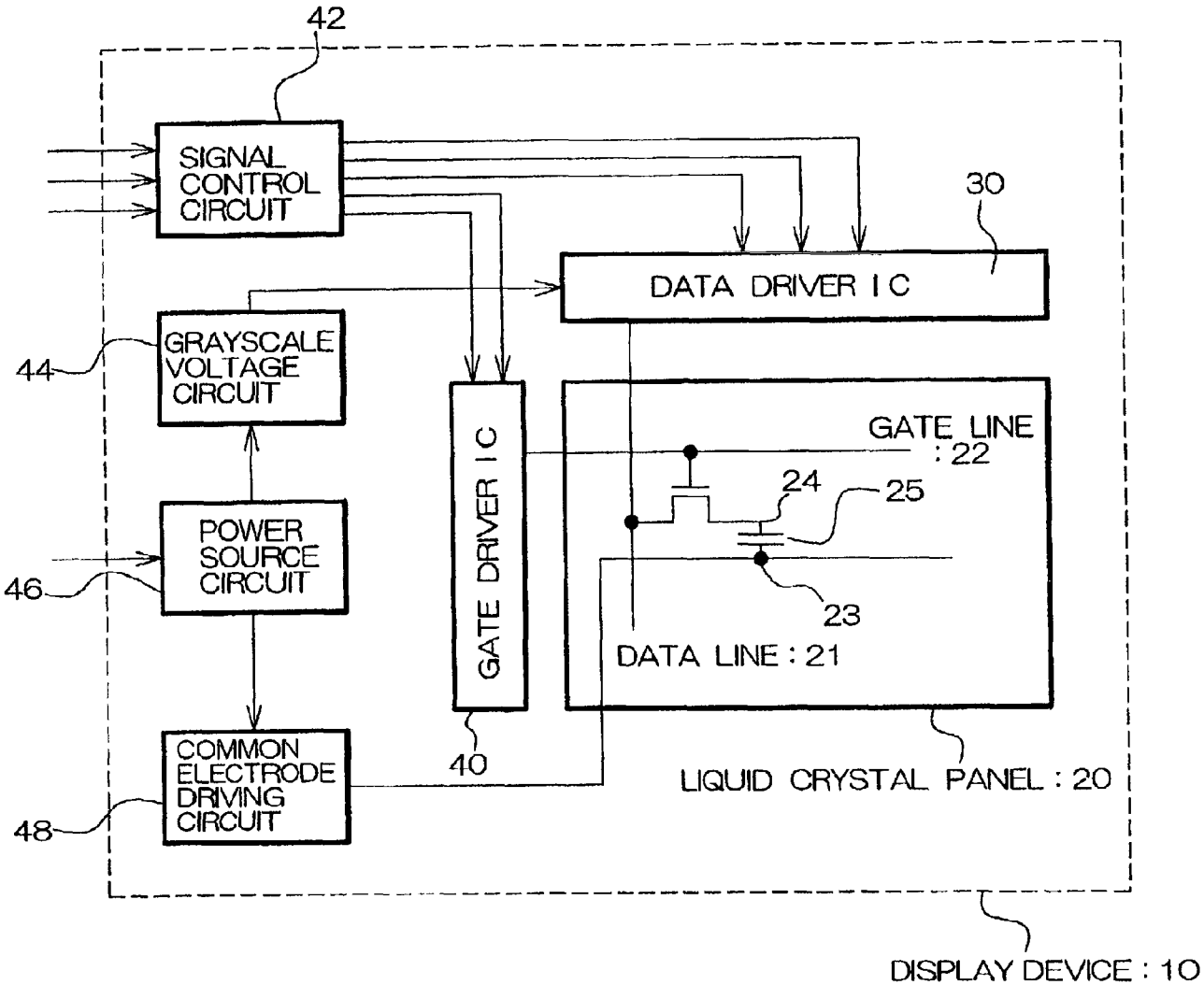
FIG. 1 is a schematic diagram showing a liquid crystal device to which the present invention is applied.

Preferred embodiments of the invention will be described below with reference to the drawings.

According to one aspect of the present invention, there is provided a voltage supplying device including a reference voltage generating circuit having a ladder resistance circuit to which a plurality of resisters are connected in series, which outputs a plurality of voltages divided in the ladder resistance circuit as a plurality of gamma-corrected reference voltages and a plurality of first impedance conversion circuits which perform impedance conversion on the plurality of reference voltages from the reference voltage generating circuit and output the converted voltages. The voltage supplying device also includes a voltage selection circuit having a plurality of analogue switches one of which is turned on based on grayscale data, which selects one of the plurality of reference voltages from the plurality of first impedance conversion circuits, a second impedance conversion circuit which performs impedance conversion on a voltage from the voltage selection circuit and outputs the converted voltage, a first switching element for blocking an output of the second impedance conversion circuit and a first bypass line for shorting input and output lines of the second impedance conversion circuit. The voltage supplying device further includes a second switching element provided on the first bypass line, a plurality of third switching elements for blocking an output of the plurality of first impedance conversion circuits, a plurality of second bypass lines for shorting input and output lines of the respective plurality of first impedance conversion circuits and a plurality of fourth switching elements provided on the respective plurality of second bypass lines.

Furthermore, the first switching element is turned on and the second switching element is turned off in the first period of the charging period, and the first switching element is turned off and the second switching element is turned on in the second period of the charging period which follows after the first period.

According to one aspect of the present invention, the output voltage from the second impedance conversion circuit is supplied to the load capacitance through the first switching element in the first period of the charging period. If an offset is present between the input and output voltages of the second impedance conversion circuit, the load capacitance will not be charged with the predetermined voltage even when the output voltage from the second impedance conversion circuit is continuously supplied to the load capacitance.

Thus, the route for voltage supplying is switched to the first bypass route in the second period of the charging time, whereby the voltage from the voltage selection circuit is directly supplied to the load capacitance without using the second impedance conversion circuit. Accordingly, the load capacitance is supplied with a voltage compensating the shortage caused by the offset and can be charged with the predetermined voltage. The charge amount per unit period of time supplied from the voltage selection circuit to the load capacitance is decreased since the impedance conversion is not performed. However, if the load capacitance has been charged with a sufficient voltage by the output voltage from the second impedance conversion circuit, the load capacitance can be charged to the predetermined voltage within the charging period.

According one aspect of the present invention, the plurality of third switching elements are turned on and the plurality of fourth switching elements are turned off in the first period of the charging period. As a result, a plurality of reference voltages from the reference voltage generating circuit are current-amplified in the plurality of first impedance conversion circuits.

Accordingly, the total resistant value of the ladder resistance circuit of the reference voltage generating circuit is increased and current flowing therethrough is reduced so as to reduce power consumption. At the same time, sufficient current can be supplied to analogue switches having load capacitance.

According to one aspect of the present invention, the plurality of third switching elements are turned off and the plurality of fourth switching elements are turned off at least in a final stage of the second period in order to form a second bypass route. Further, the plurality of third switching elements are turned on and the plurality of fourth switching elements are turned off in the other periods of the charging period. Since input/output offset is caused also in the plurality of first impedance conversion circuits, the offset can be cancelled at least in the last stage of the second period. Here, a node connected to ladder resisters and a node of output voltages are shorted. Therefore, even when the output voltages are set into non-reference voltages, the output voltages are charged/discharged in the ladder resisters and can be reset into proper reference voltages.

According to one aspect of the present invention, because a capacitance for offset canceling used in the conventional technique is not necessary, a period of time for charging the capacitance for offset canceling with an offset voltage is not necessary.

According to one aspect of the present invention, there may be a period in which both the first and second switching elements are turned off. This makes it possible to prevent positive feed back of the voltage from the voltage supplying source through the first bypass line to the impedance conversion circuit.

According to one aspect of the present invention, the voltage supplying device may further include a fifth switching element connected to a power supply line which supplies a power source voltage to the plurality of first impedance conversion circuit. The fifth switching circuit is turned off in synchronization with the off operation of the third switching element.

The voltage supplying device may further include a sixth switching element connected on a power source line which supplies a power source voltage to the second impedance conversion circuit. The sixth switching element is turned off, synchronized with an off operation of the first switching element. This makes it possible to stop the power supply when the output from the first and second impedance conversion circuits is unnecessary, so as to reduce power consumption.

The second conversion circuit used in one aspect of the present invention may be formed of a voltage follower circuit. When an input voltage having a magnitude near a power source potential VDD or a ground potential VEE is input to the voltage follower circuit, such voltage follower circuit has a property in which an output voltage is saturated and shows no linear characteristics in response to an input voltage. In this case, a voltage from the voltage supplying source is supplied to the load capacitance through the bypass line by turning off the first switching element and turning on the second switching element in a saturated region of an output voltage of the voltage follower circuit. This makes it possible to supply a linear output voltage by directly outputting a voltage from the voltage supplying source in the saturated region in which an output voltage is saturated with respect to a lower or higher input voltage in the voltage follower circuit.

According to one aspect of the present invention, there is provided a semiconductor device including the above-described voltage supplying device. In the semiconductor device, a capacitance for offset canceling is unnecessary, so that the chip size can be reduced by the area of the capacitance or other element can be integrated on the area of the capacitance to increase the degree of integration.

According to one aspect of the present invention, there is provided an electro-optical device including a display section using an electra-optical element and a semiconductor device which is provided with the above-described voltage supplying device, wherein the semiconductor device is used as a driver IC for driving a signal line of the display section. A precise driving voltage can be supplied to the electra-optical element by supplying a voltage from the voltage supplying source through a signal line of the display section to the electro-optical element.

In this case, the electro-optical element may be driven based on grayscale voltages from the voltage supplying device. The voltage selection circuit can be formed of a digital-analogue converter which converts a digital grayscale signal to an analogue voltage. The first period of the charging period may be finished after the load capacitance is charged with a voltage which has a magnitude within a range corresponding to half of the least signification bit with respect to a desired grayscale voltage value to be supplied to the electro-optical element and which has a magnitude of 90% or more of the desired grayscale voltage value. When a sufficient voltage is supplied to the electro-optical element in the first period of the charging period, the applied voltage to the electro-optical element can reach the desired grayscale voltage even when the voltage from the DA converter is directly supplied to the load capacitance in the second period of the charging period, and furthermore, the gray level in the electro-optical element can be prevented from being differentiated.

According to one aspect of the present invention, there is provided an electronic instrument including the above-described electro-optical device. Image quality can be improved by using the electro-optical device as a display of the electronic instrument.

According to one aspect of the present invention, there are provided a plurality of impedance conversion circuits between a reference voltage supplying circuit and a reference voltage generating circuit. The above-described two switching elements and bypass line are connected to the plurality of impedance conversion circuits.

First Embodiment

Liquid Crystal Device

FIG. 1 shows a construction diagram of the whole body of a liquid crystal device including a liquid crystal panel device and peripheral circuits thereof.

In FIG. 1, a liquid crystal panel 20 is, for example, a TFT type of liquid crystal panel.

A gate driver IC 40 (scanning line driver IC) connected to address lines (scanning lines) and a data driver IC 30 (signal line driver IC) connected to data lines (signal lines) are provided as a circuit driving the liquid crystal panel 20. The gate driver IC 40 and the data driver IC 30 are supplied with predetermined voltages from a power source circuit 46 and drive the data lines 21 and gate lines 22 based on the signals supplied from a signal control circuit 42. The data driver IC 30 and the gate driver IC 40 each is actually constituted by plural ICs. A grayscale voltage circuit 44 supplies a reference voltage necessary for driving based on grayscale voltages in the data driver IC 30. A liquid crystal capacitance 25 is formed by sealing a liquid crystal between a pixel electrode 24 and a common electrode 23. A common electrode driving circuit 48 supplies a common voltage to the common electrode 23.

The invention is not limited to a TFT type of liquid crystal panel but can be applied to other display panels using an electro-optical element including a liquid crystal.

Data Line Driving Circuit

Figure 2:
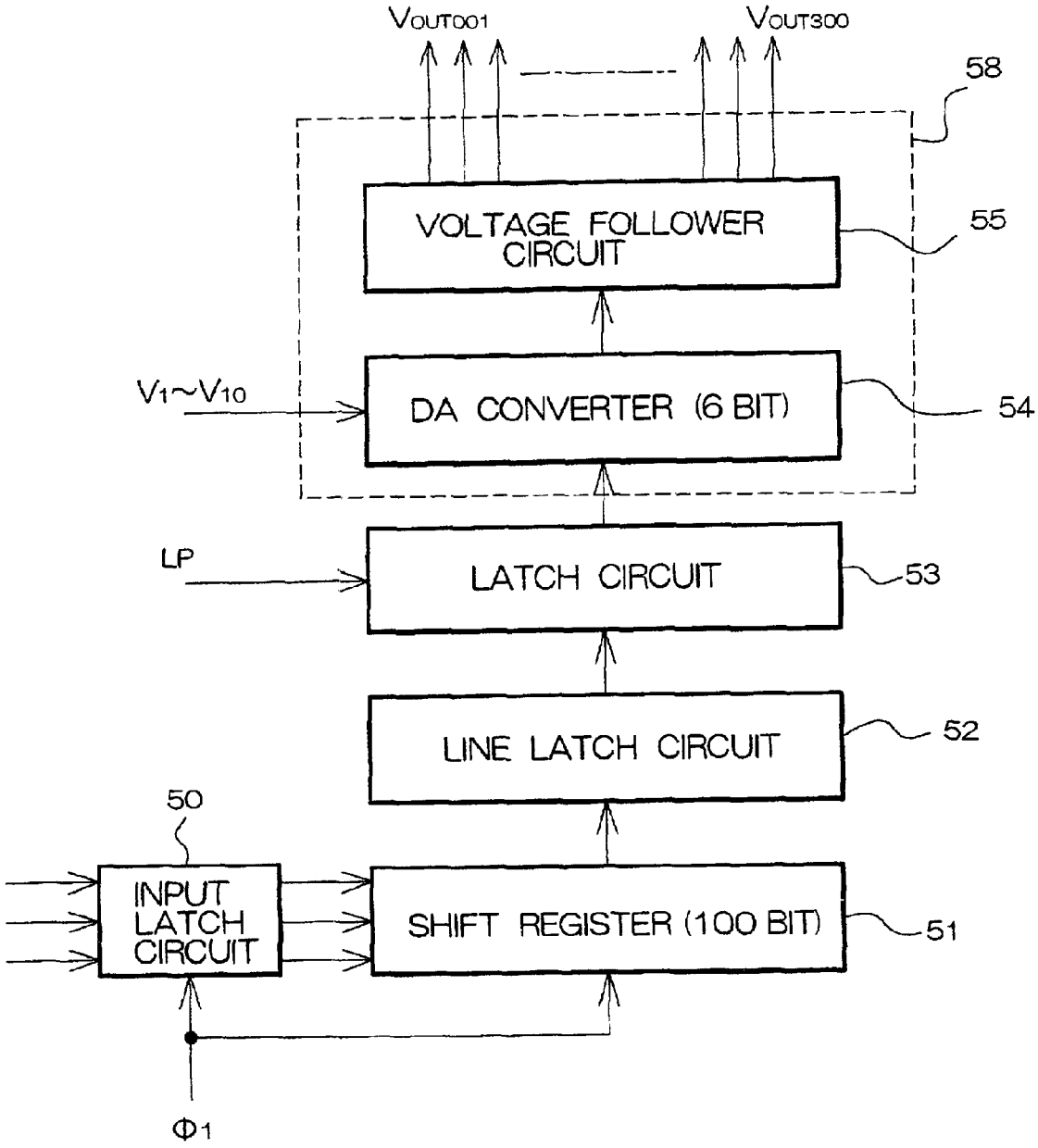
FIG. 2 PRIOR ART
FIG. 2 is a block diagram showing a conventional data driver IC.
Figure 3:
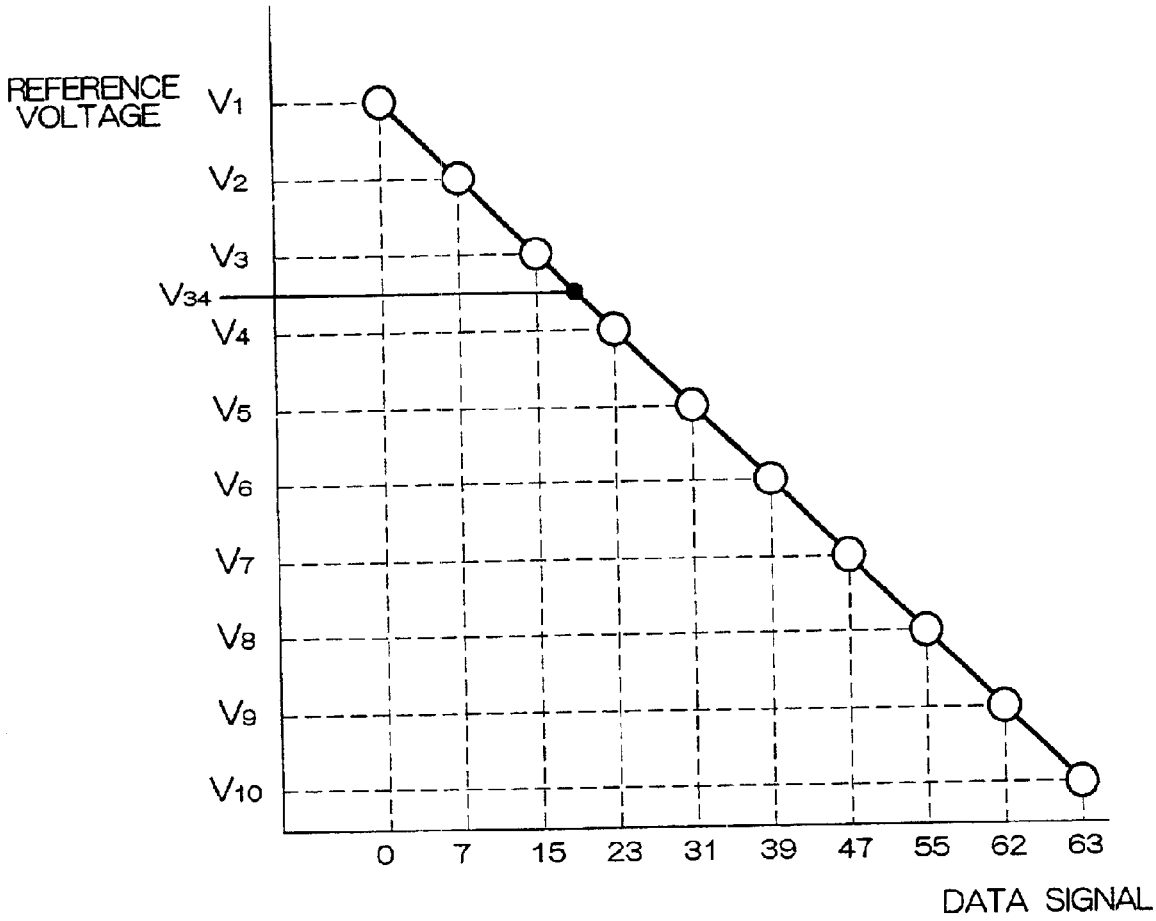
FIG. 3 PRIOR ART
FIG. 3 is a graph showing the output characteristics of the conventional data driver IC shown in FIG. 2.

FIG. 2 is a constitution diagram of the data driver IC 30 for driving the liquid crystal panel 20 shown in FIG. 1, and FIG. 3 is an example of a driving wave form driving the data line 21 in the liquid crystal panel 20 shown in FIG. 1.

FIG. 2 is a internal block diagram of the data driver IC 30 for displaying three colors and 64 grayscales, for example, having 300 output lines as the data line output 21.

In the data driver IC 30, display data composed of RGB signals each having 6 bits supplied from the signal control circuit 42 is latched by an input latch circuit 50 one by one based on the timing of a clock signal $\phi$1 similarly supplied from the signal control circuit 42. The display data corresponding to 100 clocks of the clock signal $\phi$1 (RGB×6 bits×100 clocks) is incorporated in a line latch circuit 52 through a 100-bit shift register 51. The display data is further incorporated in a latch circuit 53 at the timing of a latch pulse LP. The display data in the latch circuit 53 is converted to an analogue signal by a 6-bit DAC 54 and further subjected to impedance conversion by a voltage follower circuit 55, whereby it is supplied to the data lines 21 of the liquid crystal panel 20.

As shown in FIG. 3, the 6-bit DAC 54 generates 64 levels of grayscale voltage, and for example, 10 levels of voltages V1 to V10 are supplied from the outside. The reference voltages V1 to V10 are supplied from the grayscale voltage circuit 44. In the DAC 54, for example, one of the voltages in the voltage range divided into 10 levels of reference voltage V1 to V10 is selected by the upper three bits of each 6 bits of RGB. For example, a reference voltage between V4 and V5 is selected. Then, V34 level, which is one of the eight voltage levels in the voltage range specified by the upper three bits, for example, the voltage range between V4 and V5, is selected by the lower three bits of the data.

Voltage Supplying Device

Figure 5:
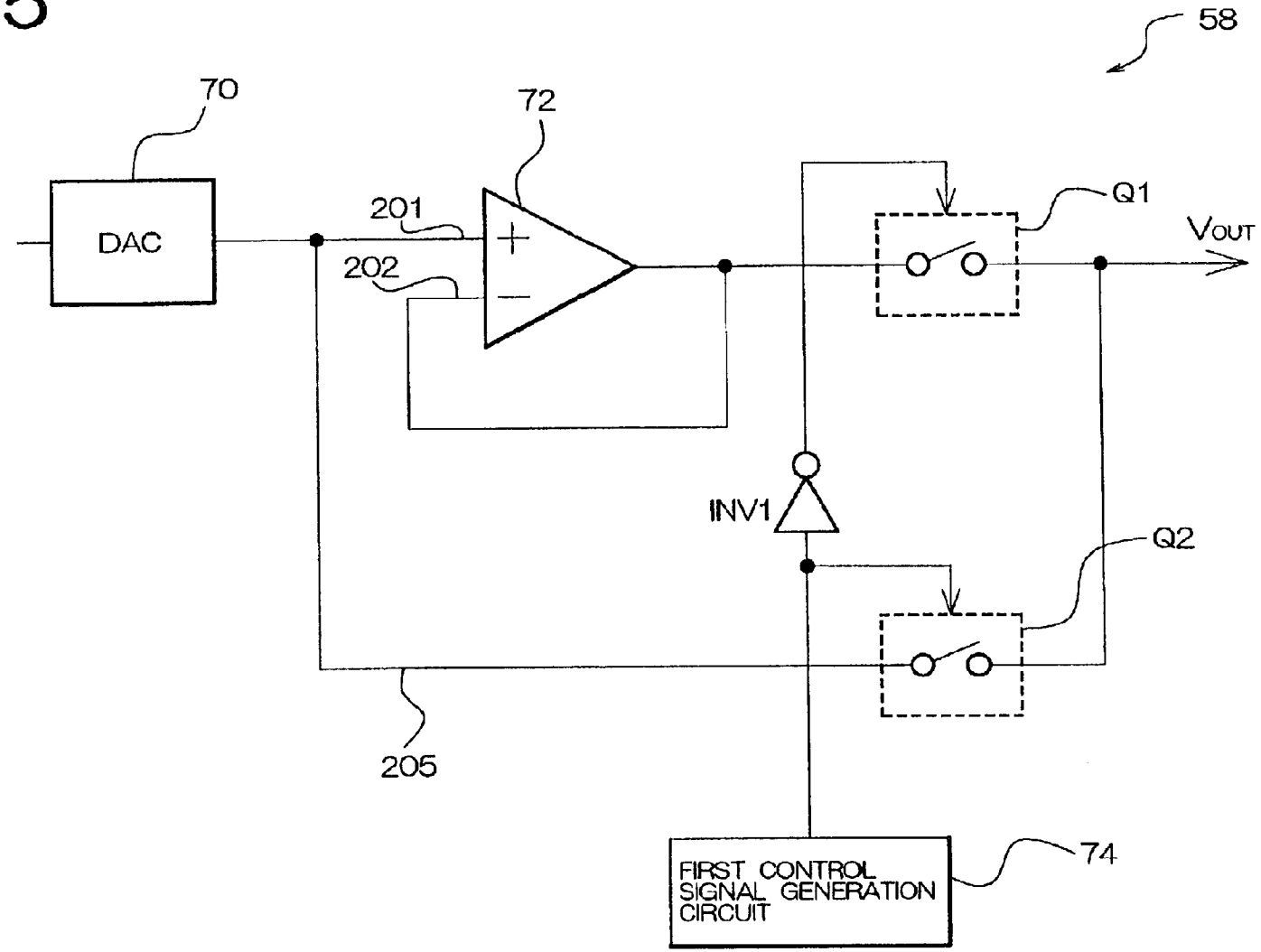
FIG. 5 is a diagram showing a voltage supplying device of the first embodiment of the invention.

FIG. 5 shows a circuit diagram of a voltage supplying device 58 outputting an output of a DAC 70 to the data lines of the TFT type of liquid crystal panel through a voltage follower circuit 72.

The DAC 70 shown in FIG. 5 is connected to one data lines 21, and the DA converter 54 shown in FIG. 2 is constituted by plural DACs 70. The relationship between the voltage follower circuit 72 and the voltage follower circuit 55 is the same.

In the circuit shown in FIG. 5, the output from the DAC 70 is supplied to anon-inverse input terminal 201 of the voltage follower circuit 72, and the output of the voltage follower circuit 72 is returned and supplied to an inverse input terminal 202. A first switching element Q1 is provided on an output line between the voltage follower circuit 72 and a load capacitance (a wiring capacitance of the data lines 21 or the liquid crystal capacitance 25). A second switching element Q2 is provided on a bypass line 205 supplying the voltage from the DAC 70 to the load capacitance bypassing the voltage follower circuit 72 and the first switching element Q1.

A control signal from a first control signal generation circuit 74 is supplied to the second switching element Q2 for on-off control. An inverter INV1 is connected to the first switching element Q1 to supply an inverse signal of the output from the first control signal generation circuit 74, so as to subject the first switching element Q1 to on-off control. The control signal is, for example, a signal CNT1 output based on the timing synchronized with the latch pulse LP of the data shown in FIG. 6B described later.

Figure 6A:
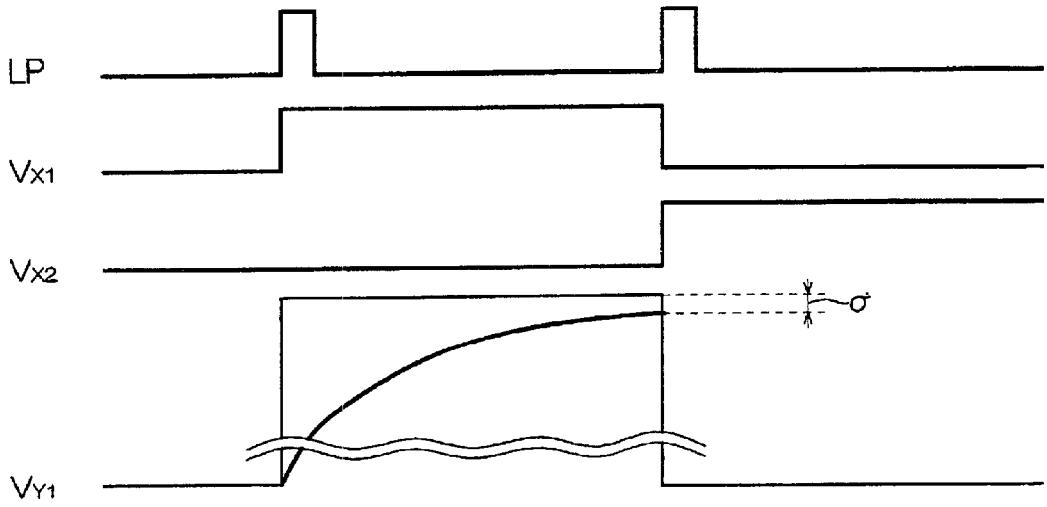
FIG. 6A is a waveform chart showing operations of the voltage supplying device of FIG. 4.

FIG. 6A shows wave forms of the latch pulse LP, the supplied voltages VX1 and VX 2 to the gate lines, and an output voltage to the data lines. Within the period of one flame, the voltage wave form charged in the liquid crystal capacitance 25 through the data line 21 in the select period of the gate line 22 is shown by VY1.

A voltage applied to the data lines 21 is demanded to have high accuracy with the increase in the number of grayscales and colors of the current liquid crystal panels. But conventionally, a potential output through the voltage follower circuit does not reach the necessary grayscale potential due to dispersion of the input and output voltages caused by offset, so that it is often difficult to set the grayscale potential in a highly accurate manner.

Figure 4:
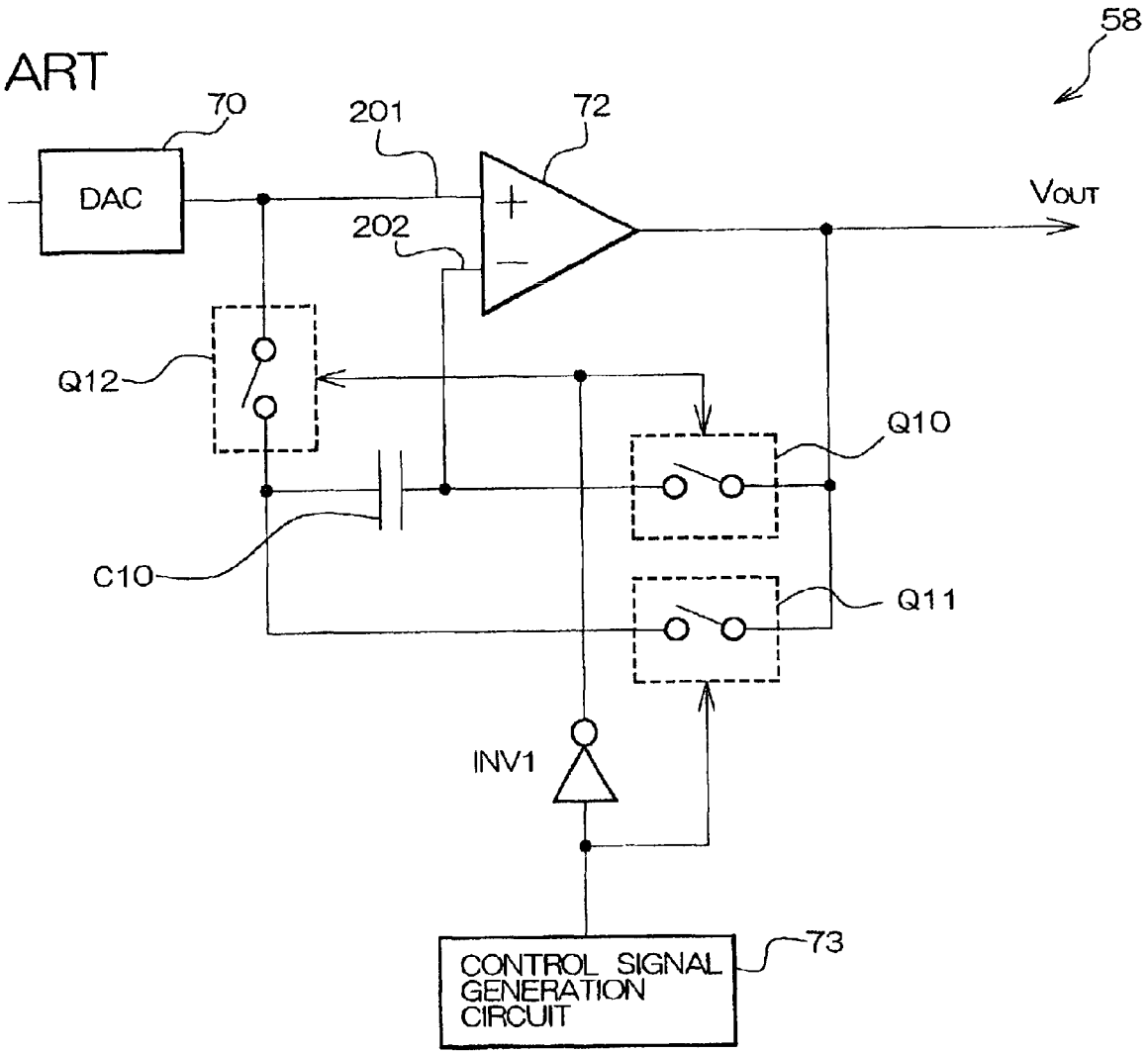
FIG. 4 PRIOR ART
FIG. 4 is a diagram showing an example of a voltage supplying device using a conventional voltage follower circuit shown in FIG. 2.

That is, as shown in FIG. 6A, it does not reach the grayscale potential within the select period t, and the potential short by $\delta$ is charged in the liquid crystal capacitance 25. The variation of the input and the output caused by the offset can be compensated by providing the offset canceling circuit as shown in FIG. 4, but it brings about such problems that the area of the capacitance C10 therefor is increased, and the speed of attaining the necessary grayscale potential is insufficient.

According to the embodiment, taking the limitation in output performance of the voltage follower circuit into consideration, switching is conducted, at a time when the grayscale potential output can be maintained to a certain extent, in such a manner that the output from the DAC 70 is supplied to the liquid crystal capacitance 25 instead of the output of the voltage follower circuit.

Figure 6B:
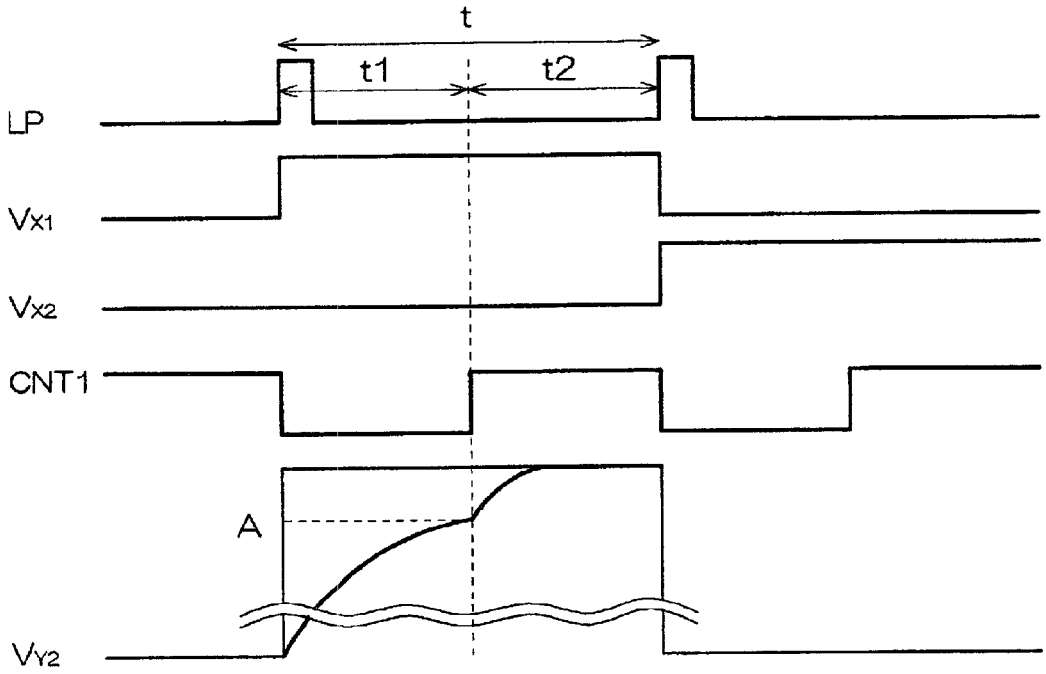
FIG. 6B is a waveform chart showing operations of the voltage supplying device of FIG. 5.

In FIG. 6B, operation of the data driver of the TFT type of liquid crystal panel device relating to the embodiment will be described below with reference to FIG. 5.

While varying depending on the specifications, it takes about a half of the select period to amplify the output of the voltage follower circuit 72 by the DAC method of the TFT type of liquid crystal device to 99% or more of the necessary voltage value. For example, in the case of the liquid crystal driver requiring 12 V, the charge amount Q=12× C (C represents a load capacitance) is necessarily charged by the output of the voltage follower circuit 72. When the difference between the input voltage and the output voltage at the end of the first period of the select period reaches 10 mV, the load capacitance (charge amount) that should be charged in the second period of the select period is Q=0.01× C. As a result, in the case of switching to the output of the DAC 70, the necessary grayscale voltage can be obtained by supplying a charge amount of 1/1,200 (about 0.1%) of the necessary charge amount Q. While the select period t varies depending on the panels, it is generally about from 8 to 12 μs for high definition display of SXGA.

A voltage VX1 is applied to one of the gate lines 21 by the gate driver IC40 over the select period t between the latch pulses LP, so as to turn the transistor on. According the procedure, the liquid crystal capacitance 25 in the liquid crystal panel 20 falls in the chargeable state. In the data driver IC30, the first switching element Q1 is turned on, and the second switching element Q2 is turned off by the control signal CNT1 output in synchronized with the latch pulses LP. Thus, a voltage VY2 is output from the voltage follower circuit 72 to the data lines 21. The voltage VY2 is charged in the liquid crystal capacitance 25 through the data lines 21, and the charge in the liquid crystal capacitance 25 shows such change in lapse of time that it reaches, for example, the point A exceeding 99% of the necessary voltage within the first period t1.

In the second period t2, the first switching element Q1 is turned off, and the second switching element Q2 is turned on, whereby the output of the voltage follower circuit 72 is cut off, so as to directly charge the output of the DAC 70 in the liquid crystal capacitance 25 through the data lines 21. In the DAC 70 at this time, while the charge amount that can be supplied per unit period of time is small, the active load influencing the output voltage is small, and the charge of the liquid crystal capacitance 25 is substantially completed, whereby the sufficient voltage can be charged in the liquid crystal capacitance 25 within the select period t.

In the case where, for example 10 mV is generated as the offset between the input and the output of the voltage follower circuit 72, switching is necessarily conducted before the necessary grayscale voltage by 10 mV. While depending on the design of the proportion between the electric current driving performances of the voltage follower circuit 72 and the DAC 70, it is appropriate to set the switching time at the time when the point A in FIG. 6B reaches 99% of the necessary voltage when the proportion is 1/100.

As described in the foregoing, in the first period t1 of the select period t, a larger charge amount per unit period of time is supplied by the output of the voltage follower circuit 72 to charge the liquid crystal capacitance 25 to a voltage of certain level. In the second period t2 of the select period t, the output of the DAC 70 is directly supplied to the liquid crystal capacitance 25, whereby a highly accurate output voltage can be rapidly obtained without necessity of the offset canceling circuit.

Operation relating to the timing of switching the output of the voltage follower circuit 72 and the output of the DAC 70 will be described with reference to FIG. 7 in the case where 90% or more of the necessary grayscale voltage is charged in the liquid crystal capacitance 25, and the voltage difference from the necessary voltage is set within the voltage range of ½ LSB (least significant bit).

Figure 7:
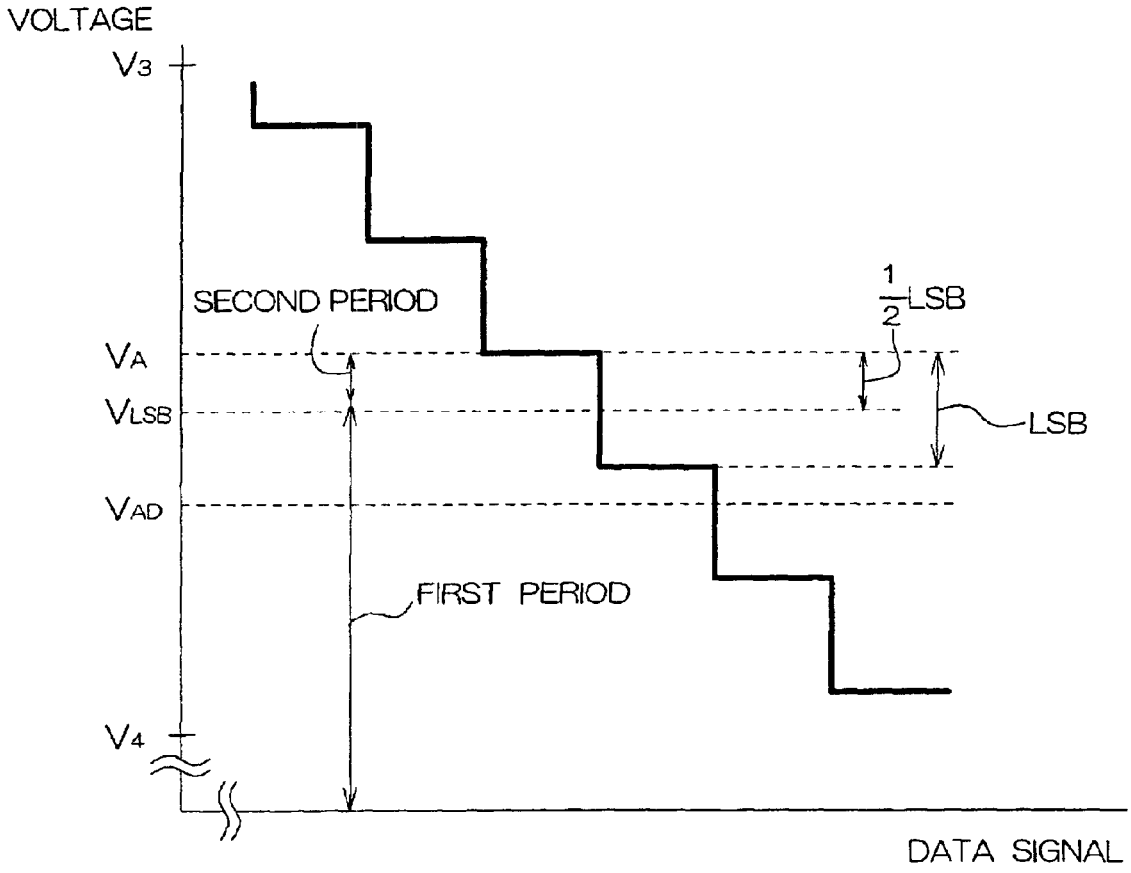
FIG. 7 is a graph showing a relationship between the voltages charged in the liquid crystal capacitance in the first and second periods of the select period.

FIG. 7 is an enlarged diagram of the wave form of the voltage applied to a liquid crystal shown in FIG. 3 between the reference voltages V3 and V4.

In order to obtain desired display of the liquid crystal, it is assumed, for example, that a voltage VA is necessary as the voltage applied to a liquid crystal. In the embodiment, it is necessary to obtain such a voltage as the voltage applied to a liquid crystal that falls in the range of the voltage VLSB corresponding to ½ LSB with respect to the necessary voltage VA (i.e., the range of from voltage VLSB to VA), and is 90% or more of the voltage VA. FIG. 7 shows an example satisfying the voltage in VAD corresponding to 90% of the necessary voltage VA, where the voltage VLSB within the range of the voltage (LSB)/2 with respect to the voltage VA is charged within the first period t1, and it is charged to the voltage VA within the second period t2.

According the configuration, the necessary liquid crystal display is ensured, and the shortage in voltage is compensated by the output of DAC 70 to obtain a highly accurate output voltage within the select period t.

With respect to the switching timing of switching the output of the voltage follower 72 and the output of the voltage output source 70, it is considered that the point, at which the grayscale voltage is ensured to a certain extent, is set as the switching timing.

Second Embodiment

Figure 8:
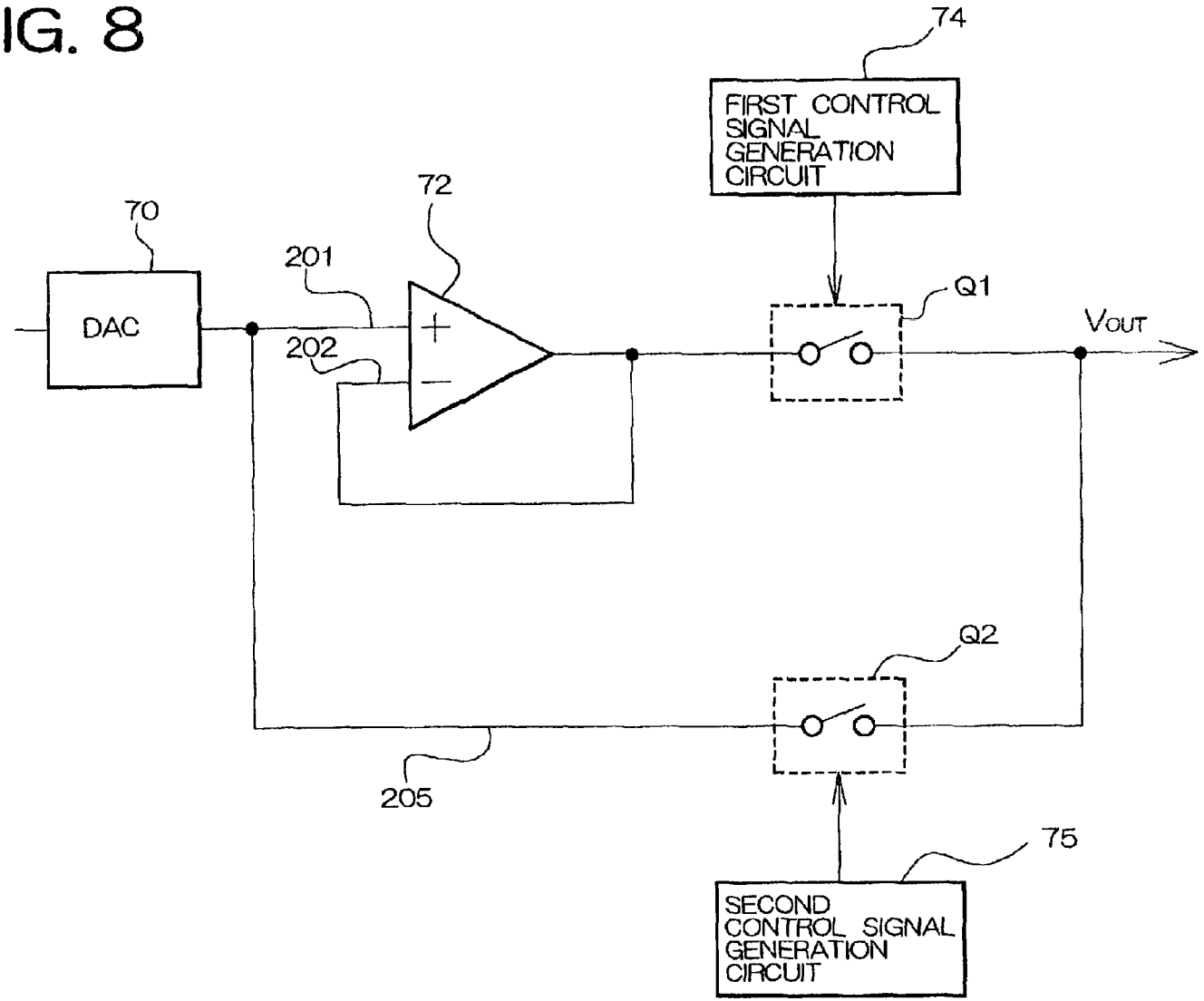
FIG. 8 is a diagram showing a voltage supplying device of the second embodiment of the invention.

FIG. 8 shows a modified example of the voltage supplying device having the constitution shown in FIG. 5.

As shown in FIG. 8, the voltage supplying device has such a constitution that a first control signal generation circuit 74 for controlling a first switching element Q1 and a second control signal generation circuit 75 for controlling a second switching element Q2, and the first switching element Q1 and the second switching element Q2 are independently controlled.

Figure 9:
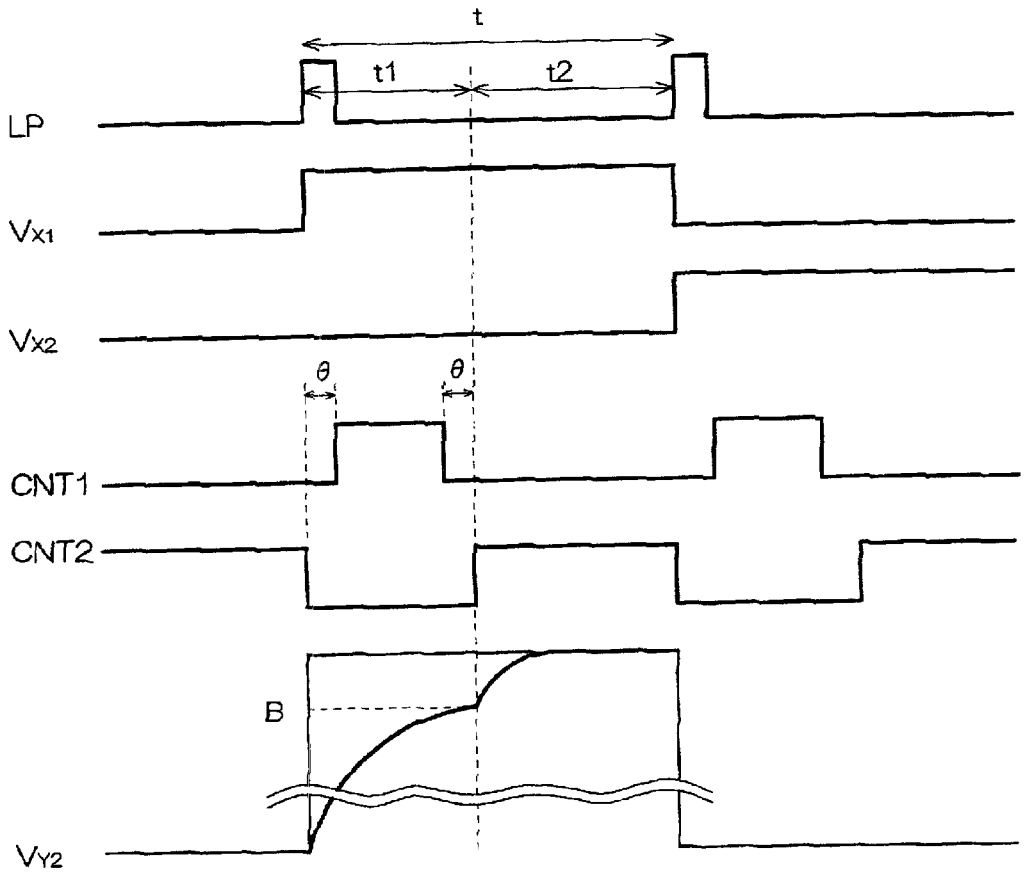
FIG. 9 is a waveform chart showing operations of the voltage supplying device of FIG. 8.

FIG. 9 shows the wave form of the embodiment shown in FIG. 8.

In FIG. 9, the first switching element Q1 is turned on by a control signal CNT1 output from a data driver IC 30 in synchronized with the latch pulses LP, and the second switching element Q2 is turned off by a control signal CNT2. At this time, the control signal CNT2 is controlled in such a manner that periods θ are present where both the first switching element Q1 and the second switching element Q2 are off.

The output of the voltage follower 72 is switched to the output of the DAC 70 by the control signals CNT1 and CNT2, so as to exhibit the wave form of the voltage applied to a liquid crystal shown by output VY2.

According to the constitution shown in FIG. 8, the first switching element Q1 and the second switching element Q2 are prevented from turning on at the same time. Furthermore, according to the constitution, such a phenomenon can be prevented from occurring that the output of the voltage follower circuit 72 is returned to the non-inverse input terminal 201 of the voltage follower circuit 72 through the second switching element Q2 to cause oscillation.

Third Embodiment

Figure 10:
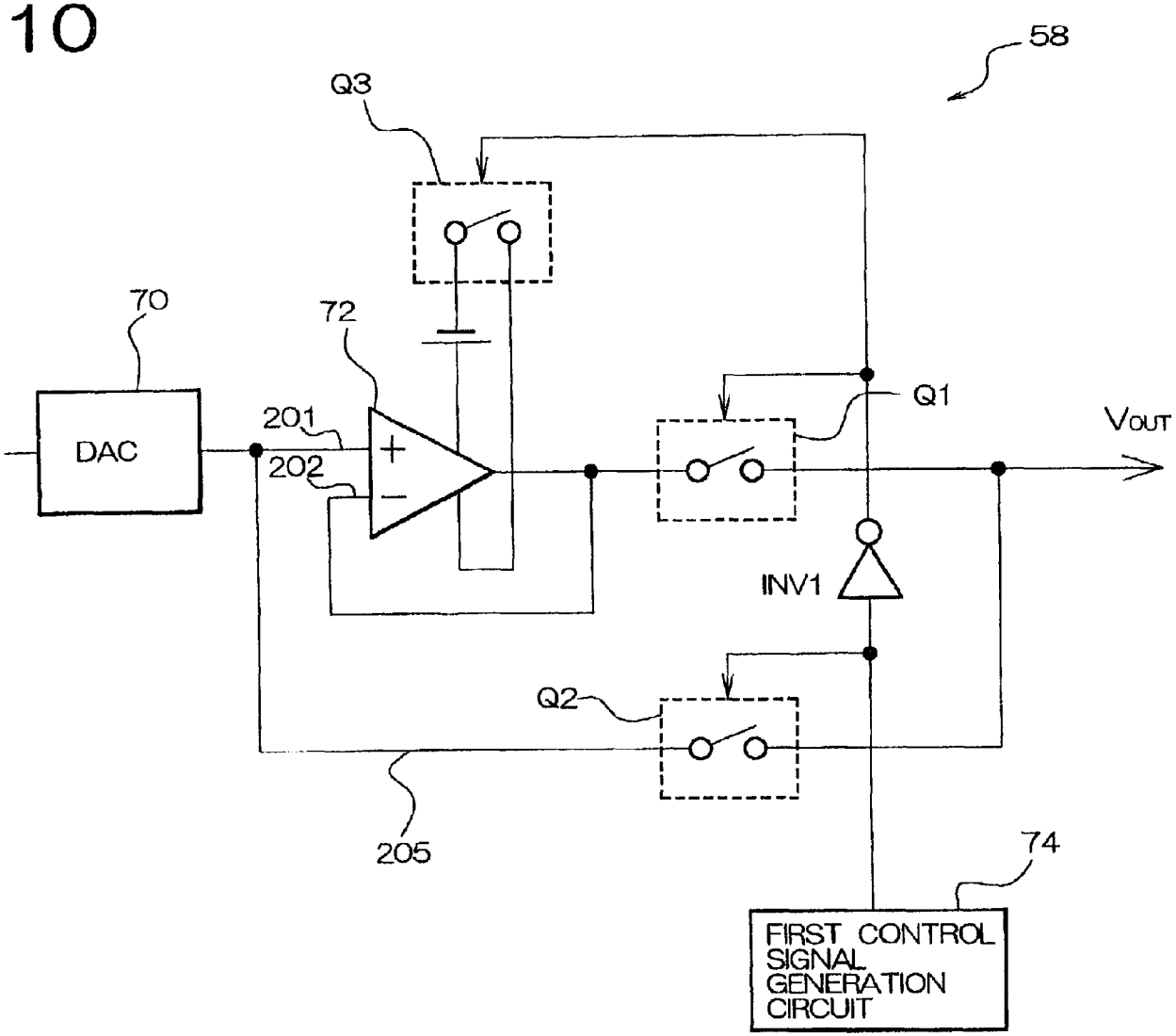
FIG. 10 is a diagram showing a voltage supplying device of the third embodiment of the invention.

In the circuit shown in FIG. 10, a third switching element Q3 is provided between the power source terminals of the voltage follower circuit 72, in addition to the circuit shown in FIG. 5. The third switching element Q3 is controlled by the control signal CNT1 in synchronized with the first switching element Q1. The operation of the DAC 70 and the voltage follower circuit 72 is the same as the circuit shown in FIG. 5.

When the output of the voltage follower circuit 72 is switched to the output of the DAC 70, the first switching element Q1 is turned off to cut off the output of the voltage follower circuit 72. The third switching element Q3 is then turned off in synchronized with the timing of turning the first switching element Q1 off, so as to cut off the power source supply to the voltage follower circuit 72.

According to the configuration, the power source supply is cut off in the period where the output of the voltage follower circuit 72 is not utilized, whereby the electric power consumption can be reduced.

Fourth Embodiment

Figure 12:
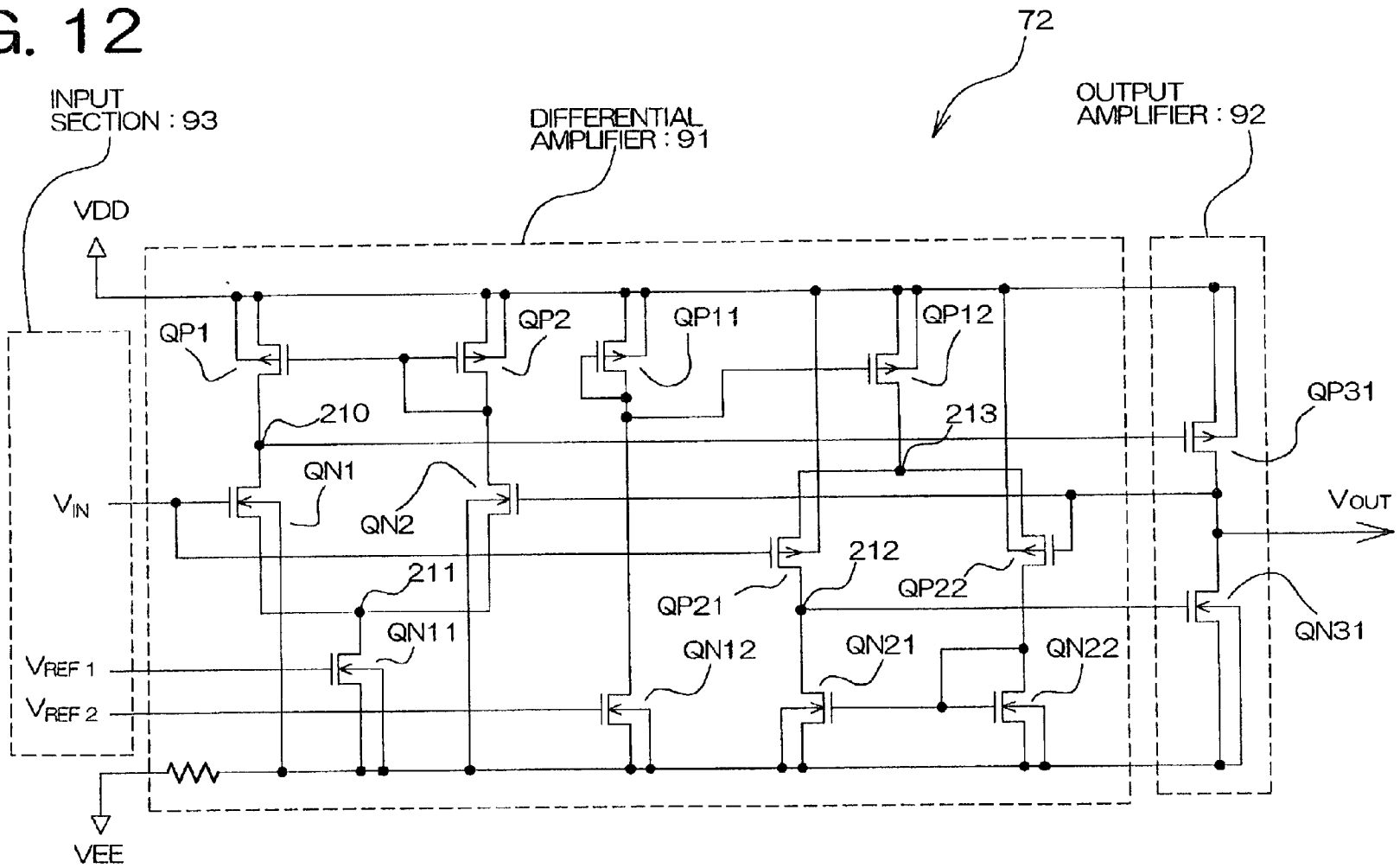
FIG. 12 is a circuit diagram of the voltage follower circuit having the characteristics shown in FIG. 11.

Examples of the constitution of the voltage follower circuit 72 include the circuit shown in FIG. 12. The circuit shown in FIG. 12 indicates a circuit of a voltage follower circuit 72 conducting class AB operational amplification, which is mainly composed of a differential amplifier 91, an output amplifier 92 and an input section 93. The circuit of FIG. 12 is constituted by N type MOS transistors QN1 to QN31 and P type MOS transistors QP1 to QP31. The voltage supplied from the DAC 70 is input as an input voltage VIN of the input section 93. Amplification in the final stage is conducted in the output amplifier 92 to supply an output voltage VOUT to the load capacitance.

Figure 11:
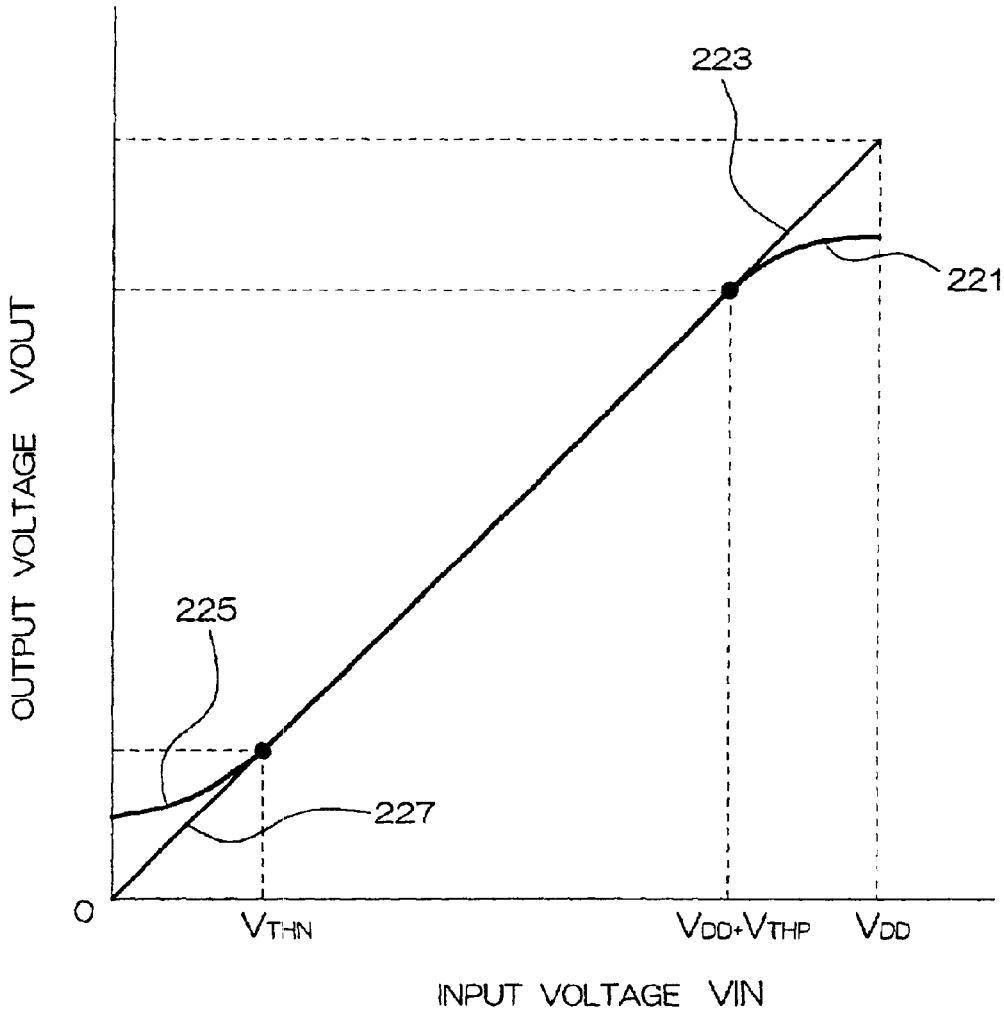
FIG. 11 is a graph showing the input and output characteristics of the voltage follower circuit used in the fourth embodiment of the invention.

The input and output characteristics of the output voltage VOUT with respect to the input voltage VIN of the voltage follower circuit 72 is shown in FIG. 11.

In the figure, VDD denotes the power source potential of the voltage follower circuit 72, and VEE denotes the ground potential.

In FIG. 11, linear input and output characteristics 227 cannot be obtained within the range of the input voltage VIN of from 0 to VTHN due to the operation of the N type MOS transistor QN31 having the threshold voltage VTHN in the output amplifier 92 in FIG. 12, but saturated output characteristics 225 appears. Similarly, linear input and output characteristics 223 cannot be obtained within the range of the input voltage VIN of from (VDD+VTHP) to VDD due to the operation of the P type MOS transistor QP31 having the threshold voltage VTHP (negative voltage) in the output amplifier, but saturated output voltage 221 appears.

In FIG. 12, when the input voltage VIN varies from 0 V to the threshold voltage VTHN, the potential of a node 212 as a drain of the P type MOS transistor QP21 connected to a gate of the N type MOS transistor QN31 in the output amplifier 92 becomes lower than the potential of a node 213 as a source. As a result, the N type MOS transistor QN31 functions to turn off in the region lower than the threshold voltage VTHN, and the electric current cannot flow. Therefore, the output voltage VOUT is saturated.

When the input voltage VIN varies from (VDD+VTHP) to the power source potential VDD, the potential of a node 210 as a drain of the N type MOS transistor QN1 connected to a gate of the P type MOS transistor QP31 in the output amplifier 92 becomes higher than the potential of a node 211 as a source. As a result, the P type MOS transistor QP31 functions to turn off in the region higher than the threshold voltage (VDD+VTIP), and the electric current cannot flow. Therefore, the output voltage VOUT is saturated.

Figure 13:
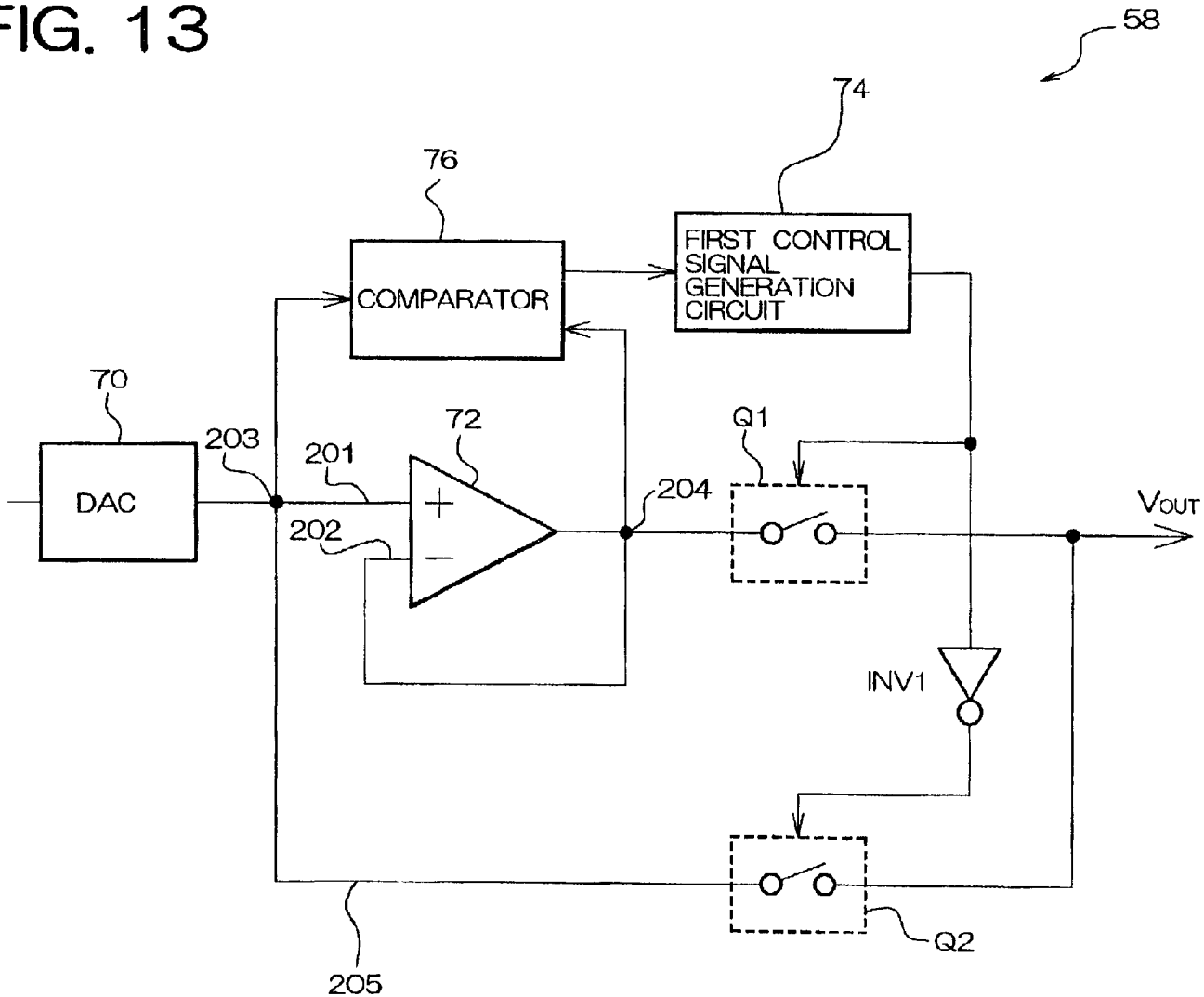
FIG. 13 is a diagram showing a voltage supplying device of the fourth embodiment of the invention containing the voltage follower circuit shown in FIG. 12.

A circuit improved in the input and output characteristics in that the output voltage is saturated due to the threshold voltages VTHN and VTHP is shown FIG. 13.

The threshold voltages VTHN and VTHP varies under the influence of a constant current circuit inside the voltage follower circuit 72, in addition to the threshold voltages inherent in the MOS transistor elements. Because a constant electric current flows by N type MOS transistors QN11 and QN12 and P type MOS transistors QP11 and QP12, the voltage corresponding to the offset is superposed. Therefore, in the embodiment, such threshold voltages VTHN and VTHP are assumed that consider the voltage corresponding to the offset.

In the circuit shown in FIG. 13, a comparator 76 is added to compare the input voltage at the node 203 and the output voltage at node 204 of the voltage follower circuit 72. Based on the compared result of the comparator 76, a control signal is supplied to the gates of the first switching element Q1 and the second switching element Q2 through the first control signal generation circuit 74.

The comparator 76 compares as to whether the output voltage VOUT at the node 204 falls within the input voltage range (VIN±ΔV) (ΔV: arbitrarily set value of error) at the node 203. The control signal is generated through the first control signal generation circuit 74. According to the operation, the first switching element Q1 is turned off, and the second switching element Q2 is turned on, whereby the output of the DAC 70 becomes the output voltage VOUT. There are cases where the output voltage VOUT is overshot or undershot with respect to the input voltage VIN to exceed or underrun the allowable range of the set value of error ±ΔV. In these cases, the allowable range considering the same (VIN±ΔV) is set, or in alternative, the gain of the output voltage VOUT is set at a large value, and the number of occurrence where the output voltage VOUT crosses a constant voltage is counted, whereby the timing of generating the control signal can be set.

Figure 14:
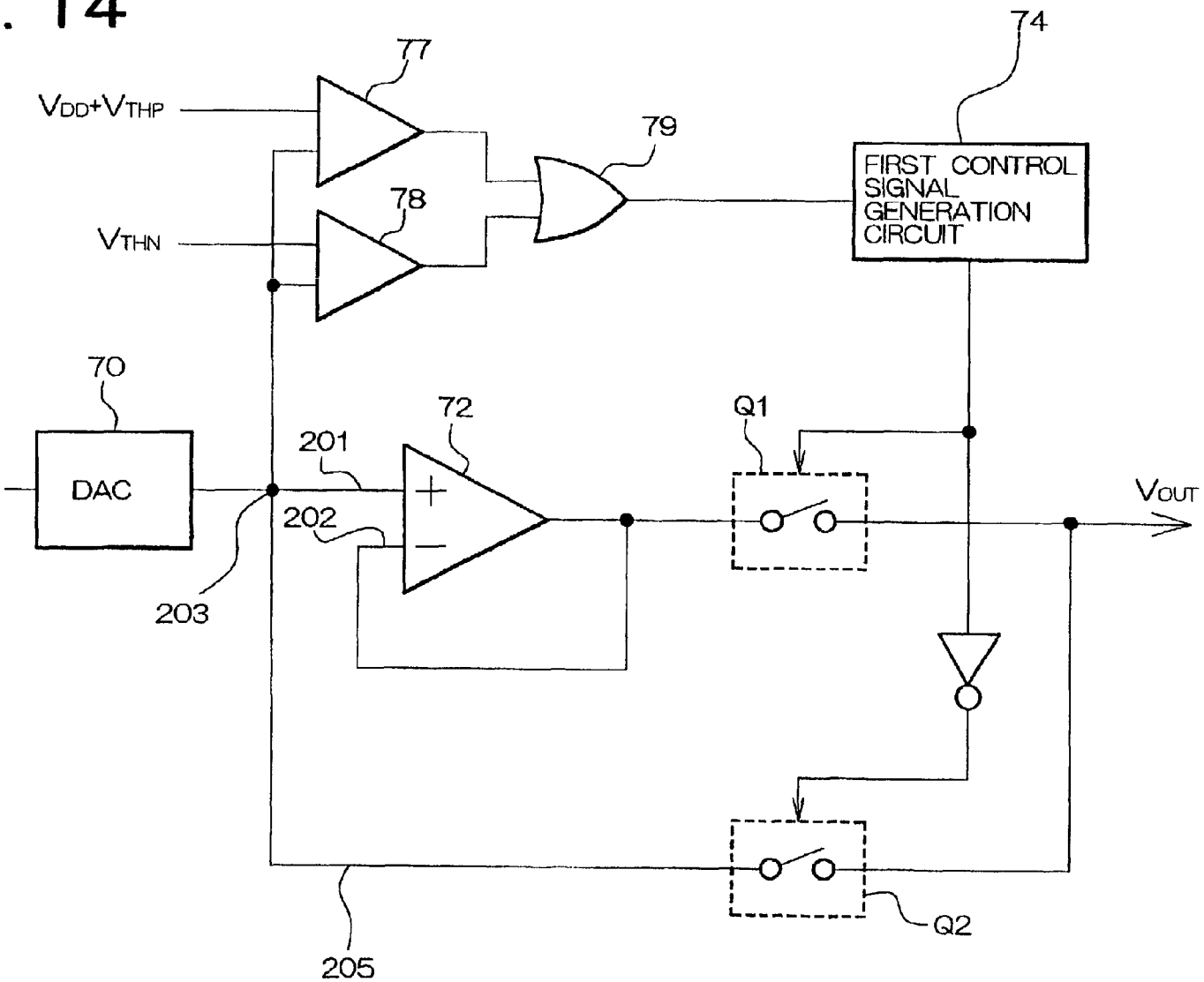
FIG. 14 is a diagram showing a modified example of the voltage supplying device shown in FIG. 13.

As a modified example of the embodiment, the method of detection shown in FIG. 14 can be considered.

The voltage supplying device shown in FIG. 14 is constituted by a first comparator 77, a second comparator 78 and an OR circuit 79 contained therein. The input voltage VIN of the voltage follower circuit 72 is compared between the voltage at the node 203 and the reference voltages set in the first comparator 77 and the second comparator 78 to provide a comparison signal, which is then supplied to the OR circuit 79. The OR circuit 79 supplies the control signal to the first switching element Q1 and the second switching element Q2 through the first control signal generation circuit 74 when at least one of the first comparator 77 and the second comparator 78 receives a high level signal.

For example, as the reference voltage of the first comparator 77, an interface point is set where the input voltage VIN at the node 203 becomes the threshold voltage (VDD+VTHP) in the input and output characteristics of the voltage follower circuit 72 shown in FIG. 11. When a voltage higher than the threshold voltage (VDD+VTHP) is input, a high level signal is output from the first comparator 77 and supplied to the OR circuit 79. A low level signal is output from the second comparator 78 and supplied to the OR circuit 79. A high level signal is thus output from the OR circuit 79 to generate the control signal through the first control signal generation circuit 74. The first switching element Q1 is turned off, and the second switching element Q2 is turned on, whereby the output of the DAC 70 becomes the output voltage VOUT. Similarly, as the reference voltage of the second comparator 78, an interface point is set where the input voltage VIN at the node 203 becomes the threshold voltage VTHN in the input and output characteristics of the voltage follower circuit 72 shown in FIG. 11. When a voltage lower than the threshold voltage VTHN is input, a high level signal is output from the second comparator 78, and a low level signal is output from the first comparator 77. A high level signal is output from the OR circuit 79 to generate the control signal through the first control signal generation circuit 74. The first switching element Q1 is turned off, and the second switching element Q2 is turned on, whereby the output of the DAC 70 becomes the output voltage VOUT.

According to the operation, when the output of the comparator 76 is varied in the range of the input voltage of from 0 to VTHN or from (VDD+VTHP) to VDD to cut off the output of the voltage follower circuit 72 at that timing, so as to switch to the output of the DAC 70, the linear output characteristics 223 can be ensured instead of the output characteristics 221 where the output voltage is saturated, or the linear output characteristics 227 can be ensured instead of the output characteristics 225.

In the case where the voltage supplying device 58 is used in a TFT liquid crystal device using the DAC method, an output voltage with high accuracy can be obtained without an offset canceling circuit. Furthermore, an output voltage with high accuracy can be obtained in the range of the input voltage from 0 V to the power source voltage VDD, and thus a voltage of a wider range can be utilized.

Fifth Embodiment

Figure 15:
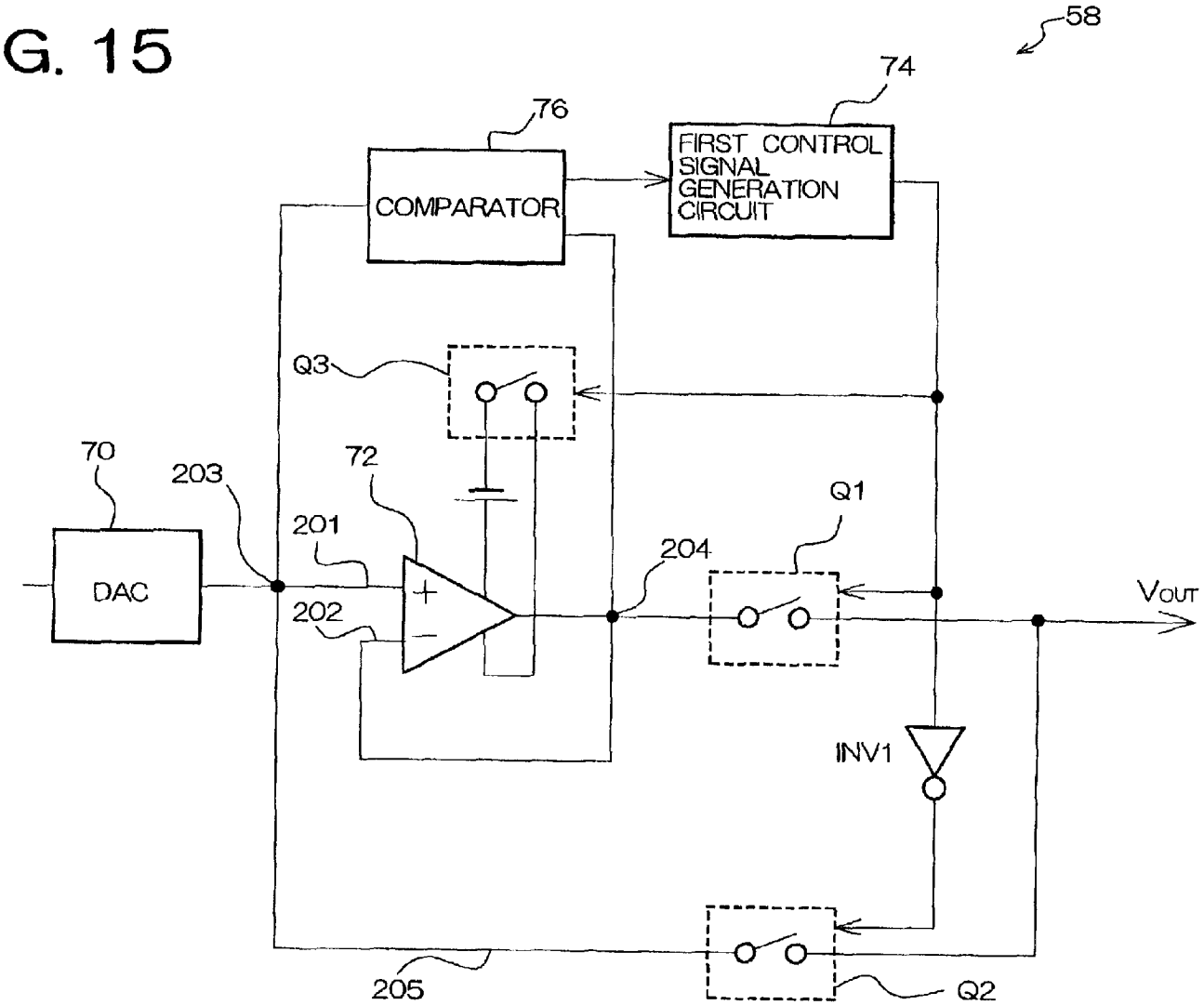
FIG. 15 is a diagram showing a voltage supplying device of the fifth embodiment of the invention.

FIG. 15 shows a circuit containing a third switching element for turning the power source voltage of the voltage follower circuit 72 on and off, in addition to a voltage supplying device having the constitution shown in FIG. 13.

As shown in FIG. 15, the power source of the voltage follower circuit 72 itself can be turned off during the period where the output of the DAC 70 is supplied as the output voltage, whereby the electric power consumption can be reduced.

The invention can be applied to various kinds of electronic instrument, such as a portable phone, a game machine, an electronic organizer, a personal computer, a word processor, a television set and a vehicle navigation system.

Sixth Embodiment

Figure 16:
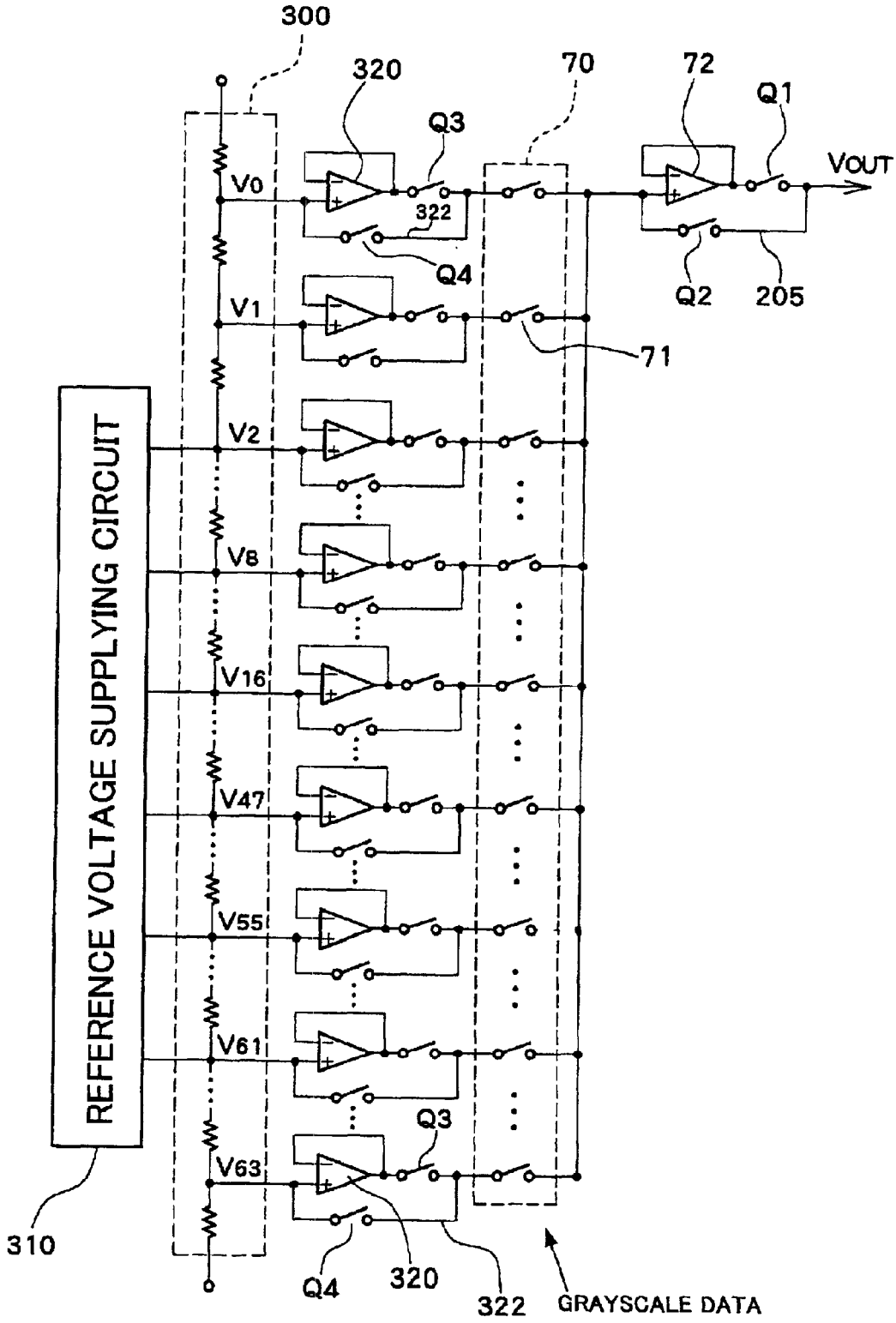
FIG. 16 is a diagram showing a voltage supplying device according to a sixth embodiment of the present invention.

FIG. 16 shows a voltage supplying device according to a sixth embodiment. Also in FIG. 16, there is provided the voltage follower circuit (a second impedance conversion circuit) 72 for performing impedance conversion on voltage selected in a DAC 70 and outputting the converted voltage. The DAC 70 may include, for example, sixty-four analogue switches 71. One of the analogue switches 71 is turned on based on grayscale data (digital data). The first and the second switching elements Q1 and Q2 are connected to the voltage follower circuit 72, and they are turned on or off at timing described in the above-described embodiments.

In FIG. 16, there is provided a reference voltage generating circuit 300 for generating sixty-four reference voltages V0 to V63 to be supplied to the DAC 70. The reference voltage generating circuit 300 includes a ladder resistor circuit to which at least sixty-five resistors are connected in series. The reference voltage generating circuit 300 outputs sixty-four voltages which have been divided in the ladder resistor circuit as sixty-four gamma-corrected reference voltages. For example, five reference voltages V2, V8, V47, V55 and V61 may be supplied to the reference voltage generating circuit 300 from the reference voltage supplying circuit 310.

Sixty-four voltage follower circuits (first impedance conversion circuits) 320 are provided between the reference voltage generating circuit 300 and the DAC 70. The sixty-four voltage follower circuits 320 perform impedance conversion on sixty-four reference voltages V0 to V63 from the reference voltage generating circuit 300 and supply them to the DAC 70. Each of the voltage follower circuits 320 includes third and fourth switching elements Q3 and Q4 like the voltage follower circuit 72 at the output side of the DAC 70. In other words, the third switching element Q3 blocks the output of the voltage follower circuit 320 while the fourth switching element Q4 forms a bypass route 322 and shorts an input/output line of the voltage follower circuit 320.

In order to generate multiple output voltages $V_{OUT}$, the reference voltage generating circuit 300 and the reference voltage supplying circuit 310 are shared, and the DAC 70 and the voltage follower circuits 72 are prepared as many as the output voltages $V_{OUT}$ require.

Here, also in the voltage supplying device shown in FIG. 16, the first switching element Q1 is turned on and the second switching element Q2 is turned off so that voltage is output from the voltage follower circuit 72 in the first period ti as shown in FIG. 6B. For example, if one analogue switch 71 is turned on in the DAC 70 and the voltage V31 is selected, the voltage follower circuit 72 performs impedance conversion on the voltage V31 and outputs the converted voltage (see FIG. 17).

Figure 17:
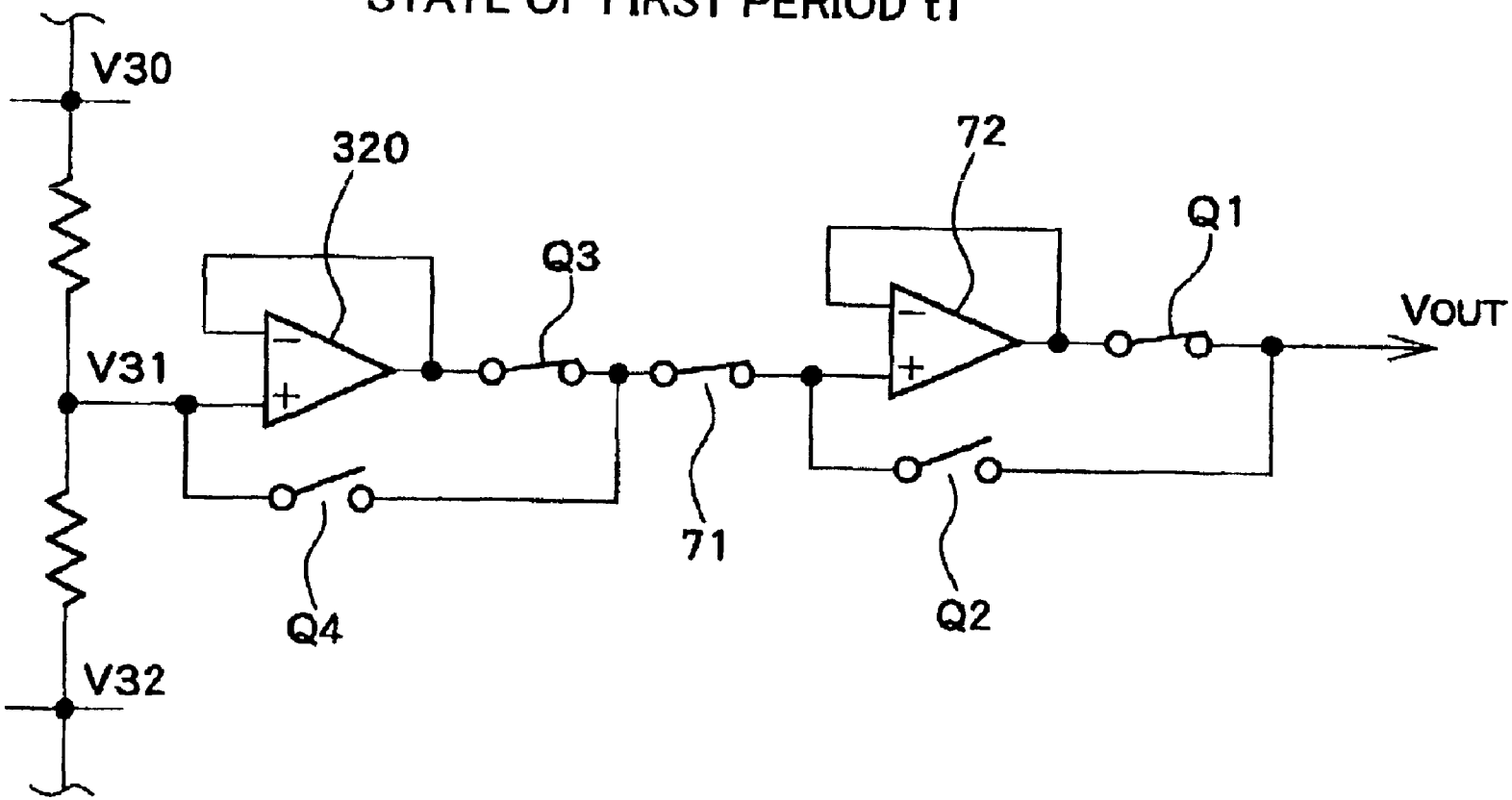
FIG. 17 is a diagram showing a connecting state of the device shown in FIG. 16 in a first period.

In the first period t1, as shown in FIG. 17, the third switching elements Q3 are turn on and fourth switching elements Q4 are turned off, which are connected to sixty-four voltage follower circuits 320. Thus, the reference voltages V0 to V63 from the reference voltage generating circuit 300 undergo impedance conversion in the voltage follower circuits 320 and are supplied to the DAC 70.

The reason why the voltage follower circuit 320 is provided is as follows: First of all, the power consumption is reduced by increasing a total resistant value of the ladder resistor provided in the reference voltage generating circuit 300 so as to reduce current flowing the resister. Assume that 300 $\mu$A current flows when the total resistant value of the ladder resistor circuit is 15 kΩ. Then, current is reduced to 250 $\mu$A when the total resistant value is 20 kΩ. As a result, without the voltage follower circuit 320, the current flowing the DAC 70 is reduced. Since the analogue switch 71 of the DAC 70 has a load capacitance, it is difficult to drive. Accordingly, output current is increased in the voltage follower circuit 320.

Next, in a second period t2 shown in FIG. 6B, the first switching element Q1 is turned off while the second switching element Q2 is turned on. The output of the DAC 70 is directly supplied through the bypass route 205 not passing through the voltage follower circuit 72 (see FIG. 18). As a result, it cancels that output/input offset of the voltage follower circuit 72 affecting the output voltage $V_{OUT}$.

However, the input/output offset in the voltage follower circuit 320 affects the output voltage $V_{OUT}$. Thus, in all or parts of the second period t2, the third switching element Q3 connected to the voltage follower circuit 320 is turned off while the fourth switching element Q4 is turned on so as to form the bypass route 322. Thus, it cancels that the input/output offset of the voltage follower circuit 320 affecting the output voltage $V_{OUT}$.

Figure 18:
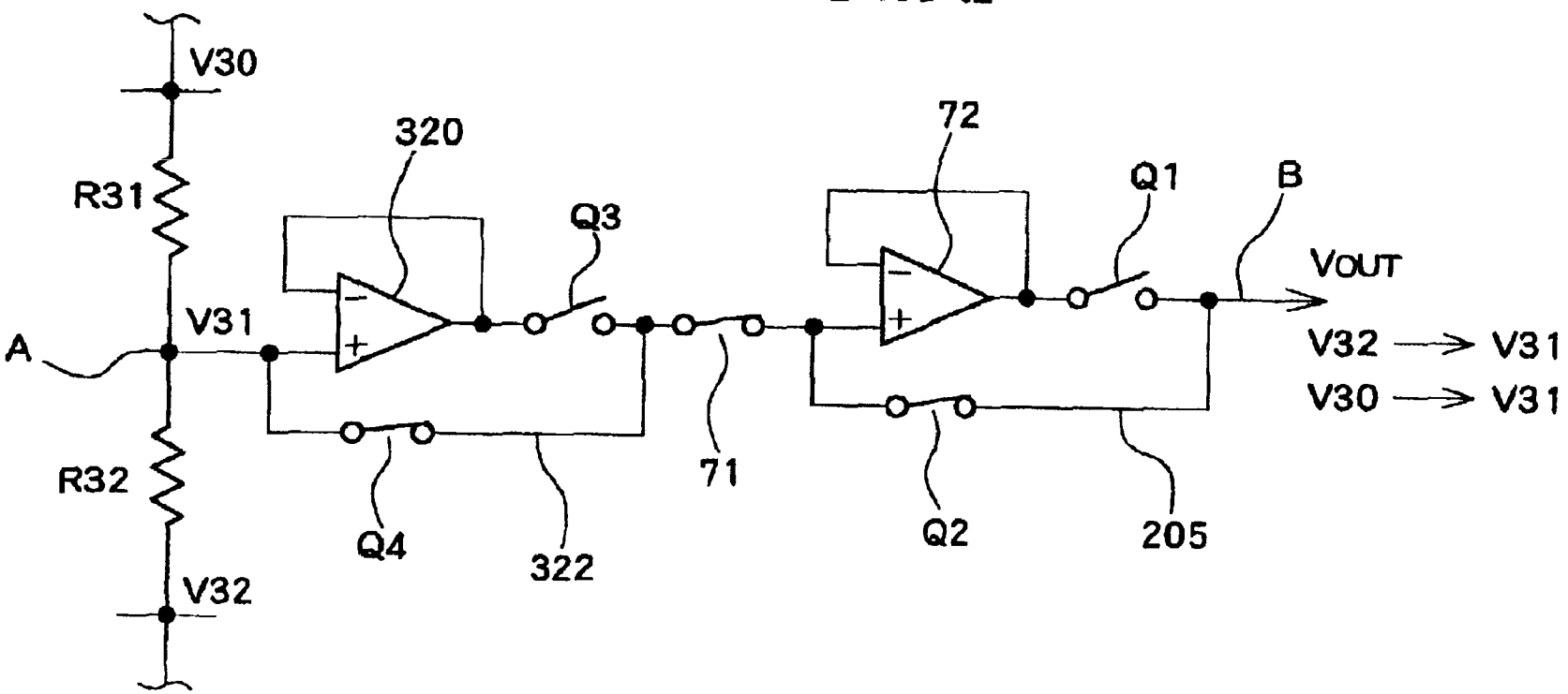
FIG. 18 is a diagram showing a connecting state of the device shown in FIG. 16 in a second period.

Here, in an extreme example, the grayscale may be inverted due to the input/output offset in a middle scale area with less grayscale voltage difference. For example, assume that the output voltage $V_{OUT}$ which must be set into the reference voltage V31 is actually set into the voltage V30 or V32 (V32<V31<V30) According to this embodiment, the voltage V31 can be reset during the second period t2. This is because, as shown in FIG. 18, a node B at the output voltage $V_{OUT}$ and a node A at a connecting point between two resistors R31 and R32 are shorted through the second and the fourth switching elements Q2 and Q4 and the analogue switch 71 of the DAC 70. If the output voltage $V_{OUT}$ is set into the higher voltage V30 or the lower voltage V32 than the actual voltage V31, current flows into the resistor R31 or R32. Then, the output voltage $V_{OUT}$ is returned to the voltage V31.

The voltage at the node A which is the connecting point of the resisters R31 and R32 is always the voltage V31 as far as the upper end of the resistor R31 is the voltage V30 and the lower end of the resister R32 is the voltage V32.

Therefore, the output voltage $V_{OUT}$ connected to the node A between the resisters R31 and R32 is always set into the voltage V31. Even though the total resistance value of the ladder resister is large, the resistance values of the resisters R31 and R32 are small. Therefore, the output voltage $V_{OUT}$ at the node B is charged or discharged by current flowing the resister R31 or R32 and then is set into the predetermined voltage V31.

Sixty-four third switching elements Q3 may be turned off and sixty-four fourth switching elements Q4 may be turned on at least during the last part of the second period t2. The timing is not limited to the entire period of the second period t2.

Further, in the device shown in FIG. 16, there are provided fifth switching elements (equivalent to the switching elements Q3 in FIG. 10) for controlling power supply to the voltage follower circuit 72. Each of the fifth switching elements may be turned on/off in synchronization with the first switching element Q1. Similarly, there are provided sixth switching elements (not shown) for controlling power supply to sixty-four voltage follower circuits 320. Each of the sixth switching elements can be turned on/off in synchronization with the third switching element Q3 shown in FIG. 16. When the bypass 322 shown in FIG. 16 is formed, the power consumption can be reduced by blocking the power supply to the voltage follower circuit 320. In this point of view, the third switching element Q3 connected to the voltage follower circuit 320 may be turned off and the fourth switching element Q4 may be turned on before the second period t2 starts. This is for increasing the effect of the low power consumption.

Seventh Embodiment

Figure 19:
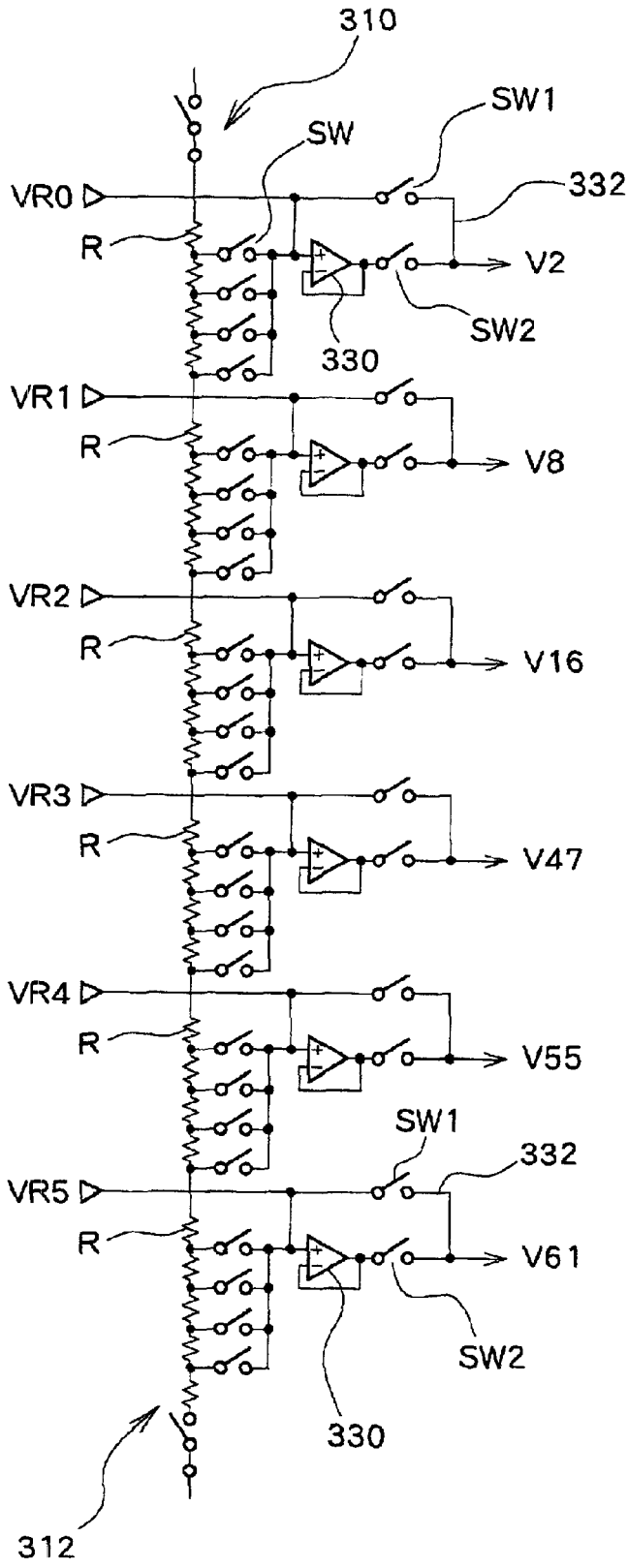
FIG. 19 is a diagram showing a reference voltage supplying circuit that is an essential part of a voltage supplying device according to a seventh embodiment of the present invention.

FIG. 19 shows an example of the reference voltage supplying circuit 310 shown in FIG. 16. The reference voltage supplying circuit 310 can supply six reference voltages V2, V8, V16, V47, V55 and V61 from the outside or through resistance division. Thus, the reference voltage supplying circuit 310 includes six input terminals VR0 to VR5 to which external reference voltages are input. Further, the reference voltage supplying circuit 310 has a ladder resister 312 to which multiple resisters R are connected in series and multiple switches SW which are connected to the multiple resisters R, respectively. If the external reference voltages V2, V8, V16, V47, V55 and V61 are input to the input terminals VR0 to VR5, all of the switches SW are turned off. Otherwise, one switch SW in each group including four switches is turned on. Thus, six reference voltages V2, V8, V16, V47, V55 and V61 generated through the resistance division are output from the reference voltage supplying circuit 310. The gamma-correction characteristic can be changed by making the six reference voltages V2, V8, V16, V47, V55 and V61 variable.

At the latter part of the reference voltage supplying circuit 310, six voltage follower circuits (first impedance conversion circuits) 330 are provided. Further, one switching element (third switching elements) SW 1 is provided between each of the voltage follower circuits 330 and the reference voltage circuit 300. That is, there are six switching elements SW1 in total. Further, there are provided six switching elements (fourth switching elements) for shorting each input/output line of six voltage follower circuits 330.

The reason why six voltage follower circuits 330 are provided are to increase the total resistant value of the ladder resistant circuit 312 so as to reduce the current flowing therein as well as to perform current amplification on six reference voltages V2, V8, V16, V47, V55 and V61 which are generated through resistance division.

Therefore, when the reference voltage generated through the resistance division, rather than external reference voltage, is used, the switching element SW1 is turned off and the switching element SW2 is turned on. Then, the voltage follower circuit 320 is used. Conversely, when the external reference voltage is input, the current amplification is not always necessary. Thus, the switching element SW1 is turned on and the switching element SW2 is turned off. As a result, the external reference voltage may be supplied through the bypass route 332, not through the voltage follower circuit 330.

Also when the external reference voltage is used, the switching element SW1 is turned off and the switching element SW2 is turned on. Then, the current amplification may be performed in the voltage follower circuit 330. In this case, the bypass route 332 may be formed so as to monitor voltage in the output stage of the voltage follower circuit 330.

The invention can be applied to various kinds of electronic instrument, such as a portable phone, a game machine, an electronic organizer, a personal computer, a word processor, a television set and a vehicle navigation system.

What is claimed is:

1. A voltage supplying device comprising:

a reference voltage generating circuit having a ladder resistance circuit to which a plurality of resisters are connected in series, which outputs a plurality of voltages divided in the ladder resistance circuit as a plurality of gamma-corrected reference voltages;

a plurality of first impedance conversion circuits which performs impedance conversion on the plurality of reference voltages from the reference voltage generating circuit and outputs the converted voltages;

a voltage selection circuit having a plurality of analogue switches one of which is turned on based on grayscale data, which selects one of the plurality of reference voltages from the plurality of first impedance conversion circuits;

a second impedance conversion circuit which performs impedance conversion on a voltage from the voltage selection circuit and outputs the converted voltage;

a first switching element for blocking an output of the second impedance conversion circuit;

a first bypass line for shorting input and output lines of the second impedance conversion circuit;

a second switching element provided on the first bypass line;

a plurality of third switching elements for blocking an output of the plurality of first impedance conversion circuits;

a plurality of second bypass lines for shorting input and output lines of the respective plurality of first impedance conversion circuits; and a plurality of fourth switching elements provided on the respective plurality of second bypass lines, wherein the first switching element is turned on and the second switching element is turned off in a first period of a charging period, and the first switching element is turned off and the second switching element is turned on in a second period of the charging period which follows after the first period; and wherein the plurality of third switching elements are turned off and the plurality of fourth switching elements are turned on at least in a final stage of the second period, and the plurality of third switching elements are turned on and the plurality of fourth switching elements are turned off in the other periods of the charging period.

2. The voltage supplying device as defined in claim 1, wherein the plurality of third switching elements are turned off and the plurality of fourth switching elements are turned on throughout the second period.

3. The voltage supplying device as defined in claim 1, further comprising a fifth switching element connected to a power supply line which supplies a power source voltage to the plurality of first impedance conversion circuits, wherein the fifth switching circuit is turned off in synchronization with an off operation of the third switching element.

4. The voltage supplying device as defined in claim 3, wherein the plurality of third switching elements are turned off and the plurality of fourth switching element are turned on before the second period starts.

5. The voltage supplying device as defined in claim 1, wherein there is a period in which both the first and the second switching elements are turned off.

6. The voltage supplying device as defined in claim 1, further comprising a sixth switching element connected on a power source line which supplies a power source voltage to the second impedance conversion circuit, wherein the sixth switching element is turned off in synchronization with an off operation of the first switching element.

7. The voltage supplying device as defined in claim 1, wherein the second impedance conversion circuit is formed of a voltage follower circuit;

wherein when an input voltage having a magnitude near a power source potential VDD is input to the voltage follower circuit, the voltage follower circuit has a property in which an output voltage is saturated and shows no linear characteristics in response to the input voltage; and wherein a voltage from the voltage supplying source is supplied to the load capacitance through the first bypass line by turning off the first switching element and turning on the second switching element in a saturated region of an output voltage of the voltage follower circuit.

8. The voltage supplying device as defined in claim 1, wherein the second impedance conversion circuit is formed of a voltage follower circuit;

wherein when an input voltage having a magnitude near a ground potential VEE is input to the voltage follower circuit, the voltage follower circuit has a property in which an output voltage is saturated and shows no linear characteristics in response to an input voltage; and wherein a voltage from the voltage supplying source is supplied to the load capacitance through the first bypass line by turning off the first switching element and turning off the second switching element in a saturated region of an output voltage of the voltage follower circuit.

9. A semiconductor device comprising the voltage supplying device as defined in claim 1.

10. An electro-optical device comprising:

a display section having an electro-optical element; and a driver IC for driving a signal line of the display section, wherein the driver IC comprises a voltage supplying device which supplies a voltage to a load capacitance to finish charging the load capacitance with a predetermined voltage within a predetermined charging period; and wherein the voltage supplying device comprises:

a reference voltage generating circuit having a ladder resistance circuit to which a plurality of resisters are connected in series, which outputs a plurality of voltages divided in the ladder resistance circuit as a plurality of gamma-corrected reference voltages;

a plurality of first impedance conversion circuits which perform impedance conversion on the plurality of reference voltages from the reference voltage generating circuit and output the converted voltages;

a voltage selection circuit having a plurality of analogue switches one of which is turned on based on grayscale data, which selects one of the plurality of reference voltages from the plurality of first impedance conversion circuits;

a second impedance conversion circuit which performs impedance conversion on a voltage from the voltage selection circuit and outputs the converted voltage;

a first switching element for blocking an output of the second impedance conversion circuit;

a first bypass line for shorting in put and output lines of the second impedance conversion circuit;

a second switching element provided on the first bypass line;

a plurality of third switching elements for blocking an output of the plurality of first impedance conversion circuits;

a plurality of second bypass lines for shorting input and output lines of the respective plurality of first impedance conversion circuits; and a plurality of fourth switching elements provided on the respective plurality of second bypass lines, wherein the first switching element is turned on and the second switching element is turned off in the first period of the charging period, and the first switching element is turned off and the second switching element is turned on in the second period of the charging period which follows after the first period; and wherein the plurality of third switching elements are turned off and the plurality of fourth switching elements are turned on at least in a final stage of the second period, and the plurality of third switching elements are turned on and the plurality of fourth switching elements are turned off in the other periods of the charging period.

11. The electro-optical device as defined in claim 10, wherein the electro-optical element is driven based on grayscale voltages from the voltage supplying device;

wherein the voltage selection circuit is formed of a digital-analogue converter which converts a digital grayscale signal to an analogue voltage; and wherein the first period of the charging period is finished after the load capacitance is charged with a voltage which has a magnitude within a range corresponding to half of the least signification bit with respect to a desired grayscale voltage value to be supplied to the electro-optical element and which has a magnitude of 90% or more of the desired grayscale voltage value.

12. An electronic instrument comprising the electro-optical device as defined in claim 8.

13. A voltage supplying device which supplies a voltage to a load capacitance to finish charging the load capacitance with a predetermined voltage within a predetermined charging period, the voltage supplying device comprising:

a reference voltage generating circuit having a ladder resistance circuit to which at least M resisters are connected in series, which outputs (M−1) voltages divided in the ladder resistance circuit as (M−1) gamma-corrected reference voltages;

a reference voltage supplying circuit connected to N resisters among the M resisters (where N<M), which selects and supplies one of N external reference voltages and N resistance divided reference voltages to the reference voltage generating circuit;

N first impedance conversion circuits which perform impedance conversion on the N resistance divided reference voltages from the reference voltage supplying circuit and output the converted voltages;

a voltage selection circuit having a plurality of analogue switches one of which is turned on based on grayscale data, which selects one of the plurality of reference voltages from the plurality of first impedance conversion circuits;

a second impedance conversion circuit which performs impedance conversion on a voltage from the voltage selection circuit and outputs the converted voltage;

a first switching element connected between the first impedance conversion circuit and the load capacitance;

a first bypass line for shorting input and output lines of the first impedance conversion circuit;

a second switching element provided on the first bypass line;

N third switching elements connected between the N first impedance conversion circuits and the reference voltage generating circuit;

N second bypass lines for shorting input and output lines of the respective N first impedance conversion circuits; and N fourth switching elements provided on the respective N second bypass lines, wherein the first switching element is turned on and the second switching element is turned off in the first period of the charging period, and the first switching element is turned off and the second switching element is turned on in the second period of the charging period which follows after the first period;

wherein when the N external reference voltages are supplied from the reference voltage supplying circuit, the N fourth switching elements are turned on and the N third switching elements are turned off in the first and the second periods; and wherein when the resistance divided reference voltage is supplied from the reference voltage supplying circuit, the N third switching elements are turned on and the N fourth switching elements are turned off in the first and the second periods.

14. A semiconductor device comprising the voltage supplying device as defined in claim 13.

15. A voltage supplying device which supplies a voltage to a load capacitance to finish charging the load capacitance with a predetermined voltage within a predetermined charging period, the voltage supplying device comprising:

a reference voltage generating circuit having a ladder resistance circuit to which at least M resisters are connected in series, which outputs (M−1) voltages divided in the ladder resistance circuit as (M−1) gamma-corrected reference voltages;

a reference voltage supplying circuit connected to N resisters among the M resisters (where N<M), which selects and supplies one of N external reference voltages and N resistance divided reference voltages to the reference voltage generating circuit;

N first impedance conversion circuits which perform impedance conversion on the N resistance divided reference voltages from the reference voltage supplying circuit and output the converted voltages;

a voltage selection circuit having a plurality of analogue switches one of which is turned on based on grayscale data, which selects one of the plurality of reference voltages from the plurality of first impedance conversion circuits;

a second impedance conversion circuit which performs impedance conversion on a voltage from the voltage selection circuit and outputs the converted voltage;

a first switching element for blocking an output of the first impedance conversion circuit;

a first bypass line for shorting input and output lines of the first impedance conversion circuit;

a second switching element provided on the first bypass line;

N third switching elements for blocking an output of the N first impedance conversion circuits;

N second bypass lines for shorting input and output lines of the respective N first impedance conversion circuits; and N fourth switching elements provided on the respective N second bypass lines, wherein the first switching element is turned on and the second switching element is turned off in the first period of the charging period, and the first switching element is turned off and the second switching element is turned on in the second period of the charging period which follows after the first period;

wherein the N third switching elements are turned on and the N fourth switching elements are turned off in the first and the second periods; and wherein when the voltages at the output sides of the N first impedance circuits are monitored, the N fourth switching elements are turned on and the N third switching elements are turned off.

16. A semiconductor device comprising the voltage supplying device as defined in claim 15.

17. A voltage supplying device comprising:

a reference voltage generating means having a ladder resistance circuit to which a plurality of resisters are connected in series, for outputting a plurality of voltages divided in the ladder resistance circuit as a plurality of gamma-corrected reference voltages;

a plurality of first impedance conversion circuits which performs impedance conversion on the plurality of reference voltages from the reference voltage generating circuit and outputs the converted voltages;

a voltage selection means having a plurality of analogue switches one of which is turned on based on grayscale data, for selecting one of the plurality of reference voltages from the plurality of first impedance conversion circuits;

a second impedance conversion circuit which performs impedance conversion on a voltage from the voltage selection means and outputs the converted voltage;

a first switching element for blocking an output of the second impedance conversion circuit;

a first bypass line for shorting input and output lines of the second impedance conversion circuit;

a second switching element provided on the first bypass line;

a plurality of third switching elements for blocking an output of the plurality of first impedance conversion circuits;

a plurality of second bypass lines for shorting in put and output lines of the respective plurality of first impedance conversion circuits; and a plurality of fourth switching elements provided on the respective plurality of second bypass lines, wherein the first switching element is turned on and the second switching element is turned off in a first period of a charging period, and the first switching element is turned off and the second switching element is turned on in a second period of the charging period which follows after the first period; and wherein the plurality of third switching elements are turned off and the plurality of fourth switching elements are turned on at least in a final stage of the second period, and the plurality of third switching elements are turned on and the plurality of fourth switching elements are turned off in the other periods of the charging period.

18. A method for supplying a voltage comprising:

providing a reference voltage generating circuit having a ladder resistance circuit to which a plurality of resisters are connected in series;

outputting a plurality of voltages divided in the ladder resistance circuit as a plurality of gamma-corrected reference voltages;

performing impedance conversion on the plurality of reference voltages from the reference voltage generating circuit and outputting the converted voltages by a plurality of first impedance conversion circuits;

providing a voltage selection circuit having a plurality of analogue switches;

turning on one of the plurality of analogue switches based on grayscale data, which selects one of the plurality of reference voltages from the plurality of first impedance conversion circuits;

performing impedance conversion on a voltage from the voltage selection circuit and outputting the converted voltage by a second impedance conversion circuit;

blocking an output of the second impedance conversion circuit by a first switching element;

shorting input and output lines of the second impedance conversion circuit by a first bypass line;

providing a second switching element provided on the first bypass line;

blocking an output of the plurality of first impedance conversion circuits by a plurality of third switching elements;

shorting input and output lines of the respective plurality of first impedance conversion circuits by a plurality of second bypass lines; and providing a plurality of fourth switching elements provided on the respective plurality of second bypass lines, turning on the first switching element and turning off the second switching element in a first period of a charging period, and turning off the first switching element and turning on the second switching element in a second period of the charging period which follows after the first period; and turning off the plurality of third switching elements and turning on the plurality of fourth switching elements at least in a final stage of the second period, and turning on the plurality of third switching elements and turning off the plurality of fourth switching elements in the other periods of the charging period.

19. The method as defined in claim 18 further comprising turning off the plurality of third switching elements and turning on the plurality of fourth switching elements throughout the second period.

20. The method as defined in claim 18 further comprising supplying a power source voltage to the plurality of first impedance conversion circuits and turning off a fifth switching circuit in synchronization with an off operation of the third switching element.

* * * * *